US011322064B2

(12) United States Patent
Sun et al.

(10) Patent No.: US 11,322,064 B2
(45) Date of Patent: May 3, 2022

(54) SIGNAL LINE CAPACITANCE COMPENSATION CIRCUIT AND DISPLAY PANEL

(71) Applicants: CHONGQING BOE DISPLAY TECHNOLOGY CO., LTD., Chongqing (CN); BOE TECHNOLOGY GROUP CO., LTD., Beijing (CN)

(72) Inventors: Shicheng Sun, Beijing (CN); Jonguk Kwak, Beijing (CN); Dawei Shi, Beijing (CN); Weixin Meng, Beijing (CN); Kai Zhang, Beijing (CN); Wei Zhang, Beijing (CN); Shuang Hu, Beijing (CN)

(73) Assignees: CHONGQING BOE DISPLAY TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/768,507

(22) PCT Filed: Dec. 13, 2019

(86) PCT No.: PCT/CN2019/125162
§ 371 (c)(1),
(2) Date: May 29, 2020

(87) PCT Pub. No.: WO2020/181863
PCT Pub. Date: Sep. 17, 2020

(65) Prior Publication Data

US 2021/0209986 A1 Jul. 8, 2021

(30) Foreign Application Priority Data

Mar. 13, 2019 (CN) ..... 201910200912.6

(51) Int. Cl.
*G09G 3/20* (2006.01)

(52) U.S. Cl.
CPC ..... *G09G 3/20* (2013.01); *G09G 2300/0426* (2013.01); *G09G 2300/08* (2013.01); *G09G 2310/0202* (2013.01); *G09G 2320/02* (2013.01)

(58) Field of Classification Search
CPC ..... G09G 3/20; G09G 2300/0426; G09G 2300/08; G09G 2310/0202; G09G 2320/02
See application file for complete search history.

(56) References Cited

U.S. PATENT DOCUMENTS 7,358,938 B2 4/2008 Kim
10,049,634 B2 8/2018 Zhang et al.
(Continued)

FOREIGN PATENT DOCUMENTS

CN 1595484 A 3/2005
CN 1804710 A 7/2006
(Continued)

OTHER PUBLICATIONS

International Search Report and Written Opinion dated Feb. 27, 2020, for corresponding PCT Application No. PCT/CN2019/125162.
(Continued)

*Primary Examiner* — Michael A Faragalla
(74) *Attorney, Agent, or Firm* — Kinney & Lange, P.A.

(57) ABSTRACT

A signal line capacitance compensation circuit and a display panel are provided, a signal line capacitance compensation circuit includes: a plurality of signal lines; at least one control line, a compensation capacitor being provided between the control line and at least one of the plurality of signal lines; and a signal source configured to send a
(Continued)

charging signal to one or more control lines of the at least one control line, the charging signal being used to charge the compensation capacitor between the one or more control lines receiving the charging signal and the at least one signal line.

19 Claims, 17 Drawing Sheets

(56) References Cited

U.S. PATENT DOCUMENTS

| | | | | |
|---|---|---|---|---|
| 2006/0284811 | A1 | 12/2006 | Huang | |
| 2009/0174831 | A1 | 7/2009 | Chien et al. | |
| 2012/0162175 | A1* | 6/2012 | Fan | G09G 3/3258 345/211 |
| 2020/0312209 | A1* | 10/2020 | Yang | G09G 3/20 |
| 2020/0335043 | A1 | 10/2020 | Zhao et al. | |

FOREIGN PATENT DOCUMENTS

| | | | |
|---|---|---|---|
| CN | 105405424 | A | 3/2016 |
| CN | 105513528 | A | 4/2016 |
| CN | 108205228 | A | 6/2018 |
| CN | 108646486 | A | 10/2018 |
| CN | 108766237 | A | 11/2018 |
| CN | 109061975 | A | 12/2018 |
| KR | 20080102798 | A | 11/2008 |

OTHER PUBLICATIONS

First Chinese Office Action dated Apr. 2, 2021, received for corresponding Chinese Patent Application No. 201910200912.6, 17 pages.

* cited by examiner

B-B

C-C

SIGNAL LINE CAPACITANCE COMPENSATION CIRCUIT AND DISPLAY PANEL

CROSS-REFERENCE TO RELATED APPLICATION

The present application is a Section 371 National Stage Application of International Application No. PCT/CN2019/125162, filed on Dec. 13, 2019, which in turn claims the benefit of Chinese Patent Application No. 201910200912.6 filed on Mar. 13, 2019 in the National Intellectual Property Administration of China, the whole disclosure of which is incorporated herein by reference.

TECHNICAL FIELD

The present disclosure relates to a field of display technology, and in particular, to a signal line capacitance compensation circuit and a display panel.

BACKGROUND

With the development of full screens, special-shaped full screens (such as "bangs" screens) with notch designs are increasingly used by mobile phone manufacturers. The special-shaped full screen is beneficial to obtain a higher screen ratio, and the notch design in the display screen may reserve design space for components such as front camera or the like. However, this notch design may cause a difference between gate electrodes of pixels on both sides of the notch and gate electrodes of normal pixels. The difference is mainly reflected in the capacitive coupling difference of the gate lines, so it is necessary to add compensation capacitors to the gate electrodes of pixels on both sides of the notch in order to compensate for the capacitive coupling difference. However, it is difficult to adjust the compensation capacitance in use by simply adding a capacitor to compensate. Once the fluctuation of the process in practice causes the compensation capacitance to deviate from the ideal value, it is difficult to achieve the ideal compensation effect.

SUMMARY

Some embodiments of the present disclosure provide a signal line capacitance compensation circuit, comprising: a plurality of signal lines; at least one control line, a compensation capacitor being provided between the control line and at least one of the plurality of signal lines; and a signal source configured to send a charging signal to one or more control lines of the at least one control line, the charging signal being used to charge the compensation capacitor between the one or more control lines receiving the charging signal and the at least one signal line.

In some embodiments, the at least one control line comprises a first control line and a second control line, and the plurality of signal lines comprises a first signal line, and a capacitance value of the compensation capacitor between the first control line and the first signal line is different from a capacitance value of the compensation capacitor between the second control line and the first signal line.

In some embodiments, the signal line capacitance compensation circuit further comprising: a switching element configured to control an on-off state between the signal source and the compensation capacitor.

In some embodiments, the signal line capacitance compensation circuit, further comprising a switching trigger line configured to provide a compensation trigger signal to the switching element, wherein the switching element comprises: a first connection terminal, the first connection terminal being connected to the signal source; a second connection terminal, the second connection terminal being connected to the compensation capacitor; and a control terminal, the control terminal being connected to the switching trigger line.

In some embodiments, the at least one control line comprises a third control line, and the plurality of signal lines comprises a second signal line, a first branch and a second branch connected in parallel are provided between the third control line and the second signal line, the first branch comprises a first compensation capacitor, the second branch comprises a branch switch and a second compensation capacitor connected in series, and a control terminal of the branch switch is electrically connected to the second signal line.

In some embodiments, the at least one control line further comprises a fourth control line, a third compensation capacitor is provided between the fourth control line and the second signal line, and the signal source is configured to send the charging signal to only one of the third control line and the fourth control line at a same moment.

In some embodiments, a capacitance value of the third compensation capacitor is the same as that of the first compensation capacitor.

In some embodiments, the plurality of signal lines comprise a first signal line, and the at least one control line comprises a first control line and a third control line, a fourth compensation capacitor is formed between the first control line and the first signal line, and a first branch and a second branch connected in parallel are provided between the third control line and the first signal line, the first branch comprises a fifth compensation capacitor, the second branch comprises a branch switch and a sixth compensation capacitor connected in series, and a control terminal of the branch switch is electrically connected to the first signal line.

In some embodiments, the at least one control line further comprises a fourth control line, a seventh compensation capacitor is provided between the fourth control line and the first signal line, and the signal source is configured to send the charging signal to only one of the third control line and the fourth control line at a same moment.

In some embodiments, a capacitance value of the fifth compensation capacitor is the same as that of the seventh compensation capacitor.

In some embodiments, the plurality of signal lines comprise a first signal line and a second signal line, the at least one control line comprises a first control line and a third control line, a fourth compensation capacitor is formed between the first control line and the first signal line, a first branch and a second branch connected in parallel are provided between the third control line and the second signal line, the first branch comprises a first compensation capacitor, the second branch comprises a branch switch and a second compensation capacitor connected in series, and a control terminal of the branch switch is electrically connected to the second signal line.

In some embodiments, the at least one control line further comprises a fourth control line, a third compensation capacitor is provided between the fourth control line and the second signal line, and the signal source is configured to send a charging signal to only one of the third control line and the fourth control line at a same moment.

In some embodiments, a capacitance value of the third compensation capacitor is the same as that of the first compensation capacitor.

In some embodiments, the at least one control line further comprises a second control line, an eighth compensation capacitor is formed between the second control line and the first signal line, and a capacitance value of the fourth compensation capacitor is different from that of the eighth compensation capacitor.

In some embodiments, the signal line capacitance compensation circuit further comprising: at least one capacitance compensation line, wherein a ninth compensation capacitor having a constant value is provided between the capacitance compensation line and at least one signal line of the plurality of signal lines, and the ninth compensation capacitor maintains a constant state of charge.

Some embodiments of the present disclosure provide a display panel, comprising: the signal line capacitance compensation circuit according to the above embodiments.

Some embodiments of the present disclosure provide a display panel, comprising: a display area for displaying images; and a non-display area at least partially surrounded by the display area, the non-display area comprising a signal line capacitance compensation area, wherein the signal line capacitance compensation area comprises a signal line layer and a control line layer, a plurality of signal lines in the signal line layer overlap with at least one control line in the control line layer, the control line layer and the signal line layer are separated by an insulating layer to form a compensation capacitor at an overlapping portion of the control line and the signal lines, and wherein the display panel further comprises a signal source, the signal source is configured to send a charging signal to one or more control lines of the at least one control line, the charging signal is used to charge the compensation capacitor between the one or more control lines receiving the charging signal and the at least one signal line.

In some embodiments, the at least one control line comprises a first control line and a second control line, and the plurality of signal lines comprise a first signal line, an overlapping area of the first control line and the first signal line is different from that of the second control line and the first signal line.

In some embodiments, the signal line capacitance compensation area further comprises a control line expansion layer, the control line expansion layer is located on a side of the signal line layer facing away from the control line layer, and is separated from the signal line layer by another insulating layer, the control line expansion layer is provided with at least one expansion control line, and each expansion control line is electrically connected to one control line in the control line layer through a conductive path, the expansion control line overlaps at least one signal line in the signal line layer, wherein the compensation capacitor comprises a first sub-compensation capacitor and a second sub-compensation capacitor, the first sub-compensation capacitor is formed by the overlapping portion of the control line and the signal line, and the second sub-compensation capacitor is formed by an overlapping portion of the expansion control line and the signal line.

In some embodiments, a switching element is further provided in the signal line capacitance compensation area, and the switching element is configured to control an on-off state of the signal source and the compensation capacitor.

In some embodiments, the switching element comprises a thin film transistor, the thin film transistor comprises: a source electrode and a drain electrode disposed in a source-drain layer; an active layer; a gate electrode between the source-drain layer and the active layer; a first insulating layer between the active layer and the gate electrode; and a second insulating layer between the source-drain layer and the gate electrode, wherein the source electrode and the drain electrode are disposed in a same layer as the at least one control line, and the gate electrode is disposed in a same layer as the first signal line, and the source electrode and the drain electrode are electrically connected to the active layer via conductive paths passing through the first insulating layer and the second insulating layer, respectively.

In some embodiments, the at least one control line comprises a third control line, the plurality of signal lines comprises a second signal line, and the third control line has a trunk portion and a branch portion extending from the trunk portion, the trunk portion comprises a first overlapping portion overlapping with the second signal line, and the branch portion comprises a second overlapping portion overlapping with the second signal line, and the second overlapping portion and the first overlapping portion are spaced apart from each other.

In some embodiments, the branch portion comprises a first portion connected to the trunk portion and a second portion comprising the second overlapping portion, the signal line capacitance compensation area is further provided with: a branch switch configured to control an on-off state of the first portion and the second portion in response to a branch trigger signal from the second signal line.

In some embodiments, the branch switch comprises a thin film transistor, the thin film transistor comprises: a source electrode and a drain electrode disposed in a source-drain layer; an active layer; a gate electrode between the source-drain layer and the active layer; a first insulating layer between the active layer and the gate; and a second insulating layer between the source-drain layer and the gate electrode, wherein the source electrode and the drain electrode are disposed in a same layer as the third control line, the gate electrode and the second signal line are disposed in a same layer, the gate electrode is electrically connected to the second signal line, the source electrode and the drain electrode are electrically connected to the active layer via conductive paths passing through the first insulating layer and the second insulating layer, respectively, wherein the first portion and the second portion of the branch portion are respectively used as the drain electrode and the source electrode of the branch switch.

In some embodiments, the at least one control line comprises a fourth control line, and the fourth control line is provided with a third overlapping portion overlapping with the second signal line.

In some embodiments, an area of the third overlapping portion is the same as an area of the first overlapping portion.

BRIEF DESCRIPTION OF THE DRAWINGS

In order to more clearly explain the technical solutions of the embodiments of the present disclosure, the drawings of the embodiments will be briefly described below. It should be understood that the drawings described below only relate to some embodiments of the present disclosure, rather than to limit the present disclosure, wherein.

DETAILED DESCRIPTION OF THE EMBODIMENTS

Figure 1A:
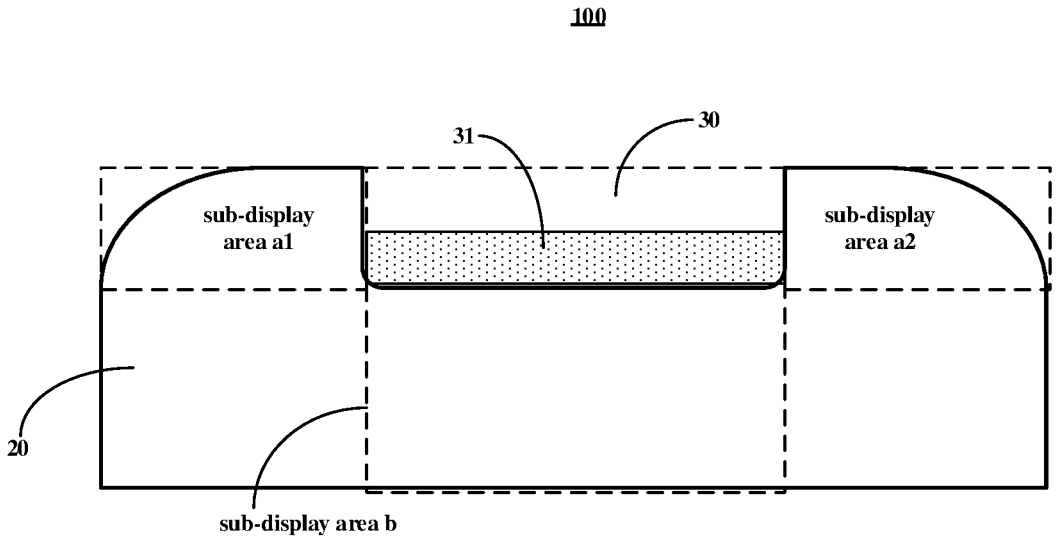
FIGS. 1A and 1B show partial schematic views of a display panel according to some embodiments of the present disclosure.

In order to more clearly explain the purposes, technical solutions and advantages of the present disclosure, the embodiments of the present disclosure will be described in detail below with reference to the drawings. It should be understood that the following description of the embodiments is intended to explain and illustrate the general concept of the present disclosure, and should not be construed as limiting the present disclosure. In the description and the drawings, the same or similar reference numerals refer to the same or similar parts or components. For clarity, the drawings are not necessarily drawn to scale, and some well-known components and structures may be omitted in the drawings.

Unless otherwise defined, the technical or scientific terms used in the present disclosure shall have the usual meanings understood by persons with general skills in the field to which the present disclosure belongs. The terms "first", "second" and similar words used in the present disclosure do not indicate any order, quantity or importance, but are only used to distinguish different components. The word "a" or "one" does not exclude more than one. Words such as "include/including", "comprise/comprising" or the like mean that the elements or objects appearing before the words cover the elements or objects listed after the words and their equivalents, but do not exclude other elements or objects. "Connect" or "connected" and similar words are not limited to physical or mechanical connections, but may include electrical connections, whether direct or indirect. "up", "down", "left", "right", "top" or "bottom", etc. are only used to indicate the relative positional relationship. When the absolute position of the described object changes, the relative positional relationship may also change accordingly. When an element such as a layer, film, region, or base substrate is referred to as being "on" or "under" another element, the element can be "directly" "on" or "under" the other element, or there may be intermediate elements.

In practice, for a special-shaped screen with a notch in a display area (such as a "bangs" screen, etc.), some gate lines may need to pass through a non-display area for wiring. Since there are no electrode patterns such as pixel units and data lines in the non-display area, a parasitic capacitance formed by a part of the gate line in the non-display area and an electrode pattern located in a different layer is relatively different from a parasitic capacitance formed by a part of the gate line in the display area and an electrode pattern located in a different layer. In this way, there may be a significant difference in the parasitic capacitance between the gate line passing through the non-display area and the gate line not passing through the non-display area (completely in the display area). The difference may affect the display effect, such as the occurrence of defects such as mura or the like. In order to compensate for the difference, a compensation capacitor may be provided for the gate line, that is, a capacitance structure is formed by the gate line and other metal layer structures, and the capacitance of the compensation capacitor is calculated through theoretical simulation. However, the inventor has noticed that in practice, the manufacturing process of the display panel may fluctuate to some extent, so the compensation capacitor in the actual product may have a certain tolerance with the theoretical compensation capacitor, and this tolerance may cause the compensation capacitor to not fully compensate, which affects the yield of the product, and introduction of the compensation capacitor may also cause changes in the mask design, thereby increasing costs.

To this end, the present application provides a signal line capacitance compensation circuit that may compensate for the parasitic capacitance of the above-mentioned gate line passing through the non-display area on the display panel while adjusting the compensation capacitance through a control circuit according to specific circumstances. With this solution, since the compensation capacitance man be adjusted within a certain range by means of the capacitance compensation circuit, on one hand, it may increase the tolerance of the compensation capacitor; on another hand, it may also provide greater freedom for the design of the display panel to avoid changing the mask design as much as possible, thereby saving costs.

Figure 1B:
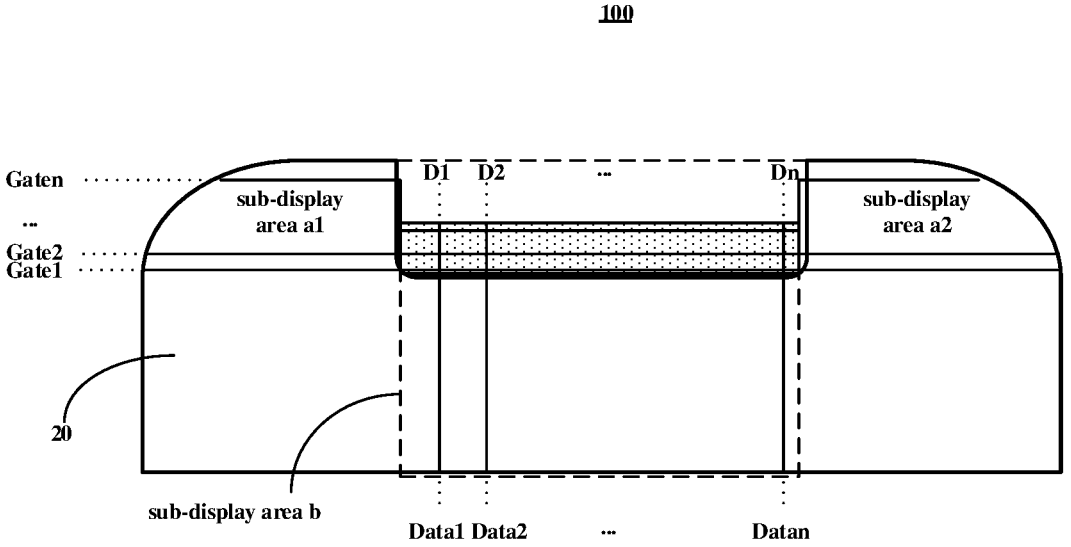

FIGS. 1A and 1B show partial schematic views of a display panel 100 according to some embodiments of the present disclosure. FIG. 1A mainly shows a partial overall outline and main area of the display panel 100, and FIG. 1B shows an exemplary arrangement of signal lines on this basis. In the display panel 100 shown in FIG. 1A, a display area 20 for displaying images and a non-display area 30 for not displaying images are provided. The non-display area 30 may be used to reserve design space for components such as a front camera or the like. In order to enlarge the area of the display area 20 as much as possible, the non-display area 30 may be at least partially surrounded by the display area 20.

In the examples of FIGS. 1A and 1B, the non-display area 30 is disposed in the notch of the display area 20, but this is only exemplary, and the embodiments of the present disclosure are not limited thereto. The non-display area 30 may also have other forms, for example, the non-display area 30 may be completely surrounded by the display area 20. As can be seen from FIGS. 1A and 1B, the gate lines in the display area portions (hereinafter referred to as "sub-display area a1" and "sub-display area a2") located on both sides of the non-display area 30 are routed through the non-display area 30. As described above, the parasitic capacitance generated by the gate line passing through the non-display area 30 is different from the parasitic capacitance generated by the gate line passing through the display area 20. The difference in the path length of the gate line also affects the parasitic capacitance generated by the gate line. For example, some gate lines (such as gate lines Gate1 and Gate2) pass through the non-display area 30 along a linear path, while some gate lines (such as gate lines Gaten) pass through the non-display area 30 along a polyline path. These gate lines using these paths actually increase the length in order to avoid some areas of the non-display area 30. This also increases the difference in parasitic capacitance generated by different gate lines.

In order to perform capacitance compensation on the gate line passing through the non-display area 30, a signal line capacitance compensation area 31 is provided in the non-display area 30. A signal line capacitance compensation circuit 200 is provided in the signal line capacitance compensation area 31 for compensating the capacitance generated by each gate line.

Figure 3:
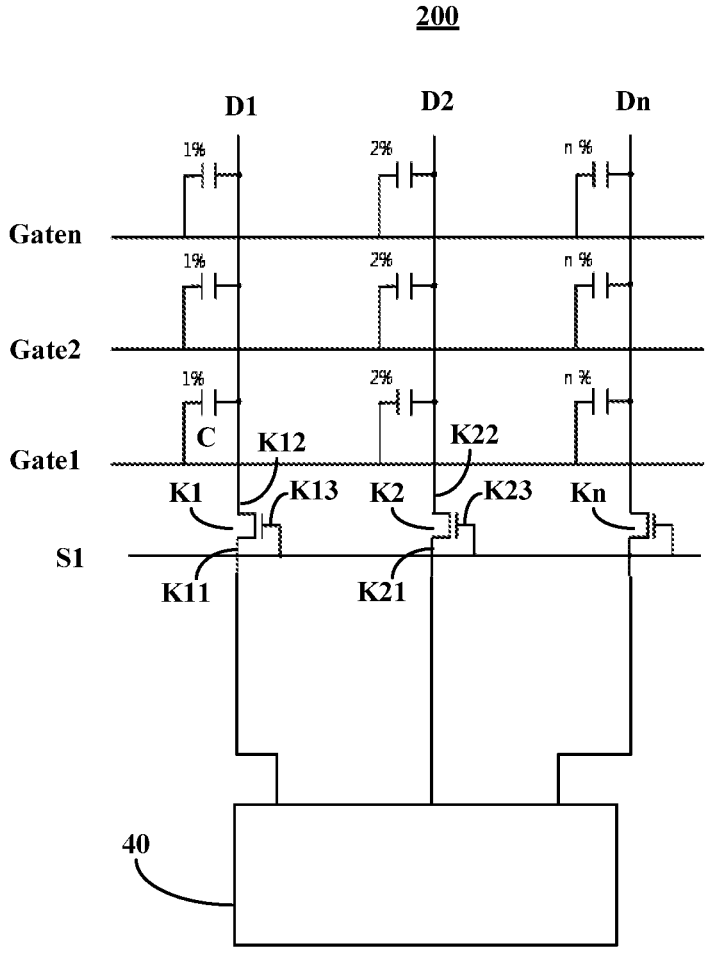
FIG. 3 shows a schematic circuit diagram of a signal line capacitance compensation circuit according to some embodiments of the present disclosure.

An example of the signal line capacitance compensation circuit 200 according to some embodiments of the present disclosure is shown in FIG. 3. The signal line capacitance compensation circuit 200 includes: gate lines Gate1, Gate2, . . . , Gaten; control lines D1, D2, . . . , Dn and a signal source 40. A compensation capacitor C is provided between each control line D1, D2, . . . , Dn and each gate line Gate1, Gate2, . . . , Gaten. The signal source 40 is configured to send a charging signal to one or more control lines of the at least one control line D1, D2, . . . , Dn, and the charging signal is used to charge the compensation capacitor between the one or more control lines receiving the charging signal and at least one gate line Gate1, Gate2, . . . , Gaten. In the case of using multiple control lines D1, D2, . . . , Dn, the signal source may send the charging signal to all control lines or a part of the control lines, so as to adjust capacitance compensation values of the gate lines Gate1, Gate2, . . . , Gaten. In other words, the compensation capacitance may be controlled according to actual needs. This may compensate for the difference in capacitance compensation values caused by errors in the manufacturing process of the display panel, and provide greater freedom for the structural design of the display panel.

In the embodiments of the present disclosure, the signal source 40 may include, for example, various signal generating devices, control switches, and the like, and may even borrow driving devices usually provided on the display panel. For example, those skilled in the art should understand that in addition to the gate lines, there are usually data lines Data1, Data2, . . . , Datan arranged across the gate lines on the display panel, as shown in FIG. 1B. In the examples of FIGS. 1A and 1B, since the non-display area 30 is in the notch of the display area 20, when the gate lines Gate1, Gate2, . . . , Gaten in the display area portions ("sub-display area a1" and "sub-display area a2") on both sides of the notch are scanned, the data lines in the display area portion (which may be called "sub-display area b", and is marked by the dotted frame in FIGS. 1A and 1B) below the notch are actually idle. Specifically, since no image is displayed in the non-display area 30 between the sub-display area a1 and the sub-display area a2, when the gate lines Gate1, Gate2, . . . , Gaten are scanned, the data lines in Data1, Data2, . . . , Datan in the sub-display area b do not need to output data for display. Therefore, the extensions of these data lines in the signal line capacitance compensation area 31 may be used as the control lines D1, D2, . . . , Dn. Accordingly, the charging signal in the control lines D1, D2, . . . , Dn may be generated by the driver of the data line. In this case, the driver of the data line may be used as the above-mentioned signal source 40, thereby avoiding addition of new circuit elements. However, this structure is only exemplary, and the control lines for performing capacitance compensation on the gate lines Gate1, Gate2, . . . , Gaten may also be independent of the above-mentioned data lines. In some embodiments, the signal source 40 may send the above-mentioned charging signal (e.g., send a high-level signal) to the control lines D1, D2, . . . , Dn only when the gate lines Gate1, Gate2, . . . , Gaten are scanned, instead of sending the charging signal all the time (for example, maintaining a low level when the above-mentioned charging signal is not transmitted). This may also be said to transmit the above-mentioned charging signal in a non-constant manner.

For example, in the example of FIG. 3, an total capacitance compensation for the gate lines is the sum of the capacitance values of each effective compensation capacitor formed between each control line D1, D2, . . . , Dn and each gate line Gate1, Gate2, . . . , Gaten. Therefore, when the total capacitance compensation of the gate lines needs to be increased, the charging signal may be applied to more control lines, and when the total capacitance compensation of the gate lines needs to be reduced, the charging signal may be applied to fewer control lines. For example, the total capacitance compensation of the gate lines refers to the sum of the capacitance values of the compensation capacitors required to compensate for the difference in the parasitic capacitances of all the gate lines caused by the non-display area 30. It may be determined according to factors such as the area of the non-display area 30 of the display panel, the circuit wiring in the display area 20, actual process deviations, etc., or it also be adjusted according to needs in practice.

Figure 2A:
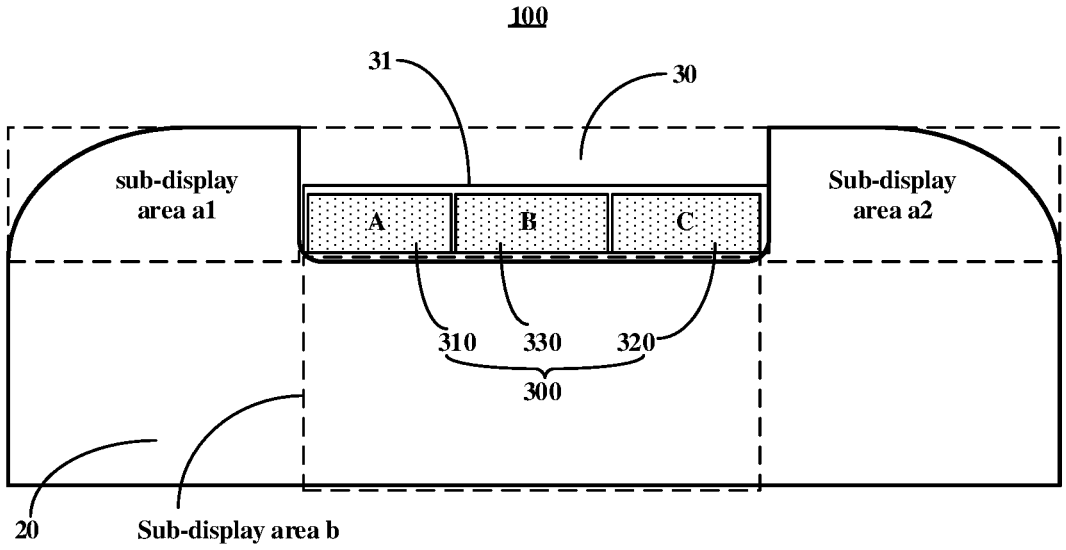
FIGS. 2A and 2B show some other partial schematic views of a display panel according to some embodiments of the present disclosure.
Figure 2B:
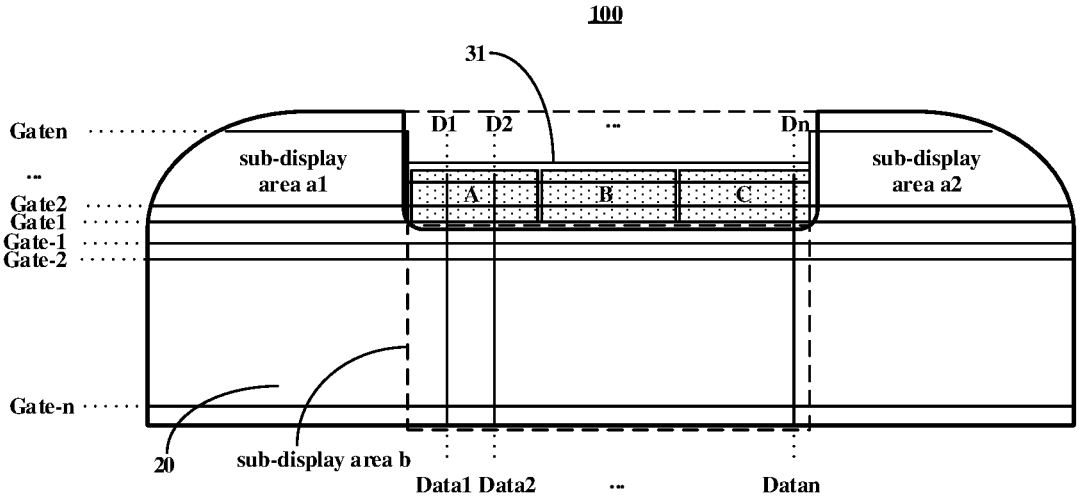

For example, for the "bangs" screen shown in FIGS. 1A to 2B, although the gate lines Gate1, Gate2, . . . , and Gaten all pass through the non-display area, their wiring patterns are different. In some embodiments, as shown in FIG. 2B, in order to avoid components, such as a camera or the like, disposed in the upper portion of the non-display area 30, the signal line capacitance compensation area 31 is usually disposed at the lower portion of the non-display area 30, close to the bottom of the notch. Therefore, the gate lines (such as the gate line Gaten) passing through the upper portions of the sub-display area a1 and the sub-display area a2 have to be bent downward at the edge of the non-display area and extend into the signal line capacitance compensation area 31, and the gate lines (such as the gate line Gate1) passing through the lower portions of the sub-display area a1 and the sub-display area a2 may directly extend into the signal line capacitance compensation area 31. Taking the comparison of the gate line Gate1 and the gate line Gaten as an example, the gate line Gaten extends shorter than the gate line Gate1 in the display area (sub-display area a1), and extends longer than the gate line Gate1 in the non-display area. Therefore, in some embodiments, in order to reduce the difference between the parasitic capacitances involved in respective gate lines, the gate line Gaten may be given a larger capacitance compensation value than the gate line Gate1, for example, the capacitance compensation values may be sequentially decreased from the gate line Gaten to the gate line Gate1. However, the embodiments of the present disclosure are not limited to this, and those skilled in the art may design capacitance compensation values for different gate lines according to specific requirements.

In some embodiments, for a same gate line, the compensation capacitors respectively formed by different control lines and the same gate line may have different capacitance values. For example, in the example shown in FIG. 3, the compensation capacitance between the control line D1 and each gate line Gate1, Gate2, . . . , Gaten is 1% of a total nominal capacitance compensation of the corresponding gate line. The compensation capacitance between the control line D2 and each gate line Gate1, Gate2, . . . , and Gaten is 2% of the total nominal capacitance compensation of the corresponding gate line. The compensation capacitance between the control line Dn and each gate line Gate1, Gate2, . . . , Gaten is n % of the total nominal capacitance compensation of the corresponding gate line. The so-called "total nominal capacitance compensation" refers to a total capacitance compensation value expected to be applied for each gate line, which may be determined by factors such as the length of the corresponding gate line, the ratio of the length of the corresponding gate line in the non-display area 30 to the length of the corresponding gate line in the display area 20. In work, due to manufacturing process and other reasons, the actual required total capacitance compensation may be different from the total nominal capacitance compensation, therefore, various actual total capacitance compensation may be obtained by disconnecting and connecting the different control lines D1, D2, . . . , Dn. In addition, in practice, multiple signal line capacitance compensation circuits may be used in combination, so it is not required that the sum of the capacitance values of all the compensation capacitors of all signal line capacitance compensation circuits for a single gate line reaches 100% of the total nominal capacitance compensation. For example, in the above example, when n is 6, and all the switching elements of the control lines are closed, the sum of the capacitance values of the compensation capacitors for each gate line may reach 21% of the total nominal capacitance compensation.

Although n gate lines and n control lines are provided in the above example, the embodiments of the present disclosure are not limited thereto. For example, the signal line capacitance compensation circuit 200 may include one or more signal lines (e.g., gate lines) and at least one control line, a compensation capacitor may be provided between the control line and one or more signal lines.

In some embodiments, the signal line capacitance compensation circuit 200 may further include a switching element. The switching element is configured to control an on-off state of the signal source and the compensation capacitor. For example, the switching element may be configured to connect the at least one control line in a closed state to turn on a path of the signal source to the compensation capacitor and to disconnect the at least one control line in an open state to turn off the path of the signal source to the compensation capacitor. Specifically, the switching element may include, for example, a plurality of control switches K1, K2, . . . , Kn, which are used to control the connection and disconnection of the paths of the signal source 40 to the compensation capacitors on control lines, respectively. In some embodiments, the control switches K1, K2, . . . , Kn may be closed when the corresponding gate lines Gate1, Gate2, . . . , Gaten are scanned, and may be open when gate lines Gate-1, Gate-2, . . . , Gate-n in other part of the display area 20 (e.g., the sub-display area b in FIGS. 1A and 1B) are scanned, so as to prevent the control lines D1, D2, . . . , Dn from interfering with the image display of the other part of the display area 20.

For example, the above-mentioned multiple control switches K1, K2, . . . , Kn may be controlled by an integrated circuit outside the signal line capacitance compensation circuit 200 to connect the required control lines to charge the corresponding compensation capacitors. In some embodiments, the switching element may have a first connection terminal connected to the signal source and a second connection terminal connected to the compensation capacitor, and a control terminal for controlling on-off between the first connection terminal and the second connection terminal. In some embodiments, the signal line capacitance compensation circuit 200 may further include a switching trigger line S1. Taking the first control switch K1 and the second control switch K2 in the example shown in FIG. 3 as an example, the first connection terminal K11 of the first control switch K1 is connected to the signal source 40, and the second connection terminal K12 is connected to the compensation capacitors respectively formed between the control line D1 and the gate lines Gate1, Gate2, . . . , and Gaten. Similarly, the first connection terminal K21 of the second control switch K2 is also connected to the signal source 40, and the second connection K22 is connected to the compensation capacitors respectively formed between the control line D2 and the gate lines Gate1, Gate2, . . . , Gaten. The switching trigger line S1 is electrically connected to the control terminal K13 of the first control switch K1 and the control terminal K23 of the second control switch K2. The switching trigger line S1 is configured to provide a compensation trigger signal to the first control switch K1 and the second control switch K2. The first control switch K1 and the second control switch K2 switch between an open state and a closed state in response to the compensation trigger signal. In some embodiments, the plurality of control switches K1, K2, . . . , Kn may be controlled to switch between the open state and the closed state together, or may be controlled to be open and closed independently.

By loading the corresponding compensation trigger signal on the switching trigger line S1, the opening and closing of each control switch may be controlled. In some embodiments, multiple control switches (for example, the first control switch K1 and the second control switch K2) may be connected to the same switch trigger line S1, or may be connected to different switch trigger lines, so that each control switch may be at least controlled independently better.

Figure 4:
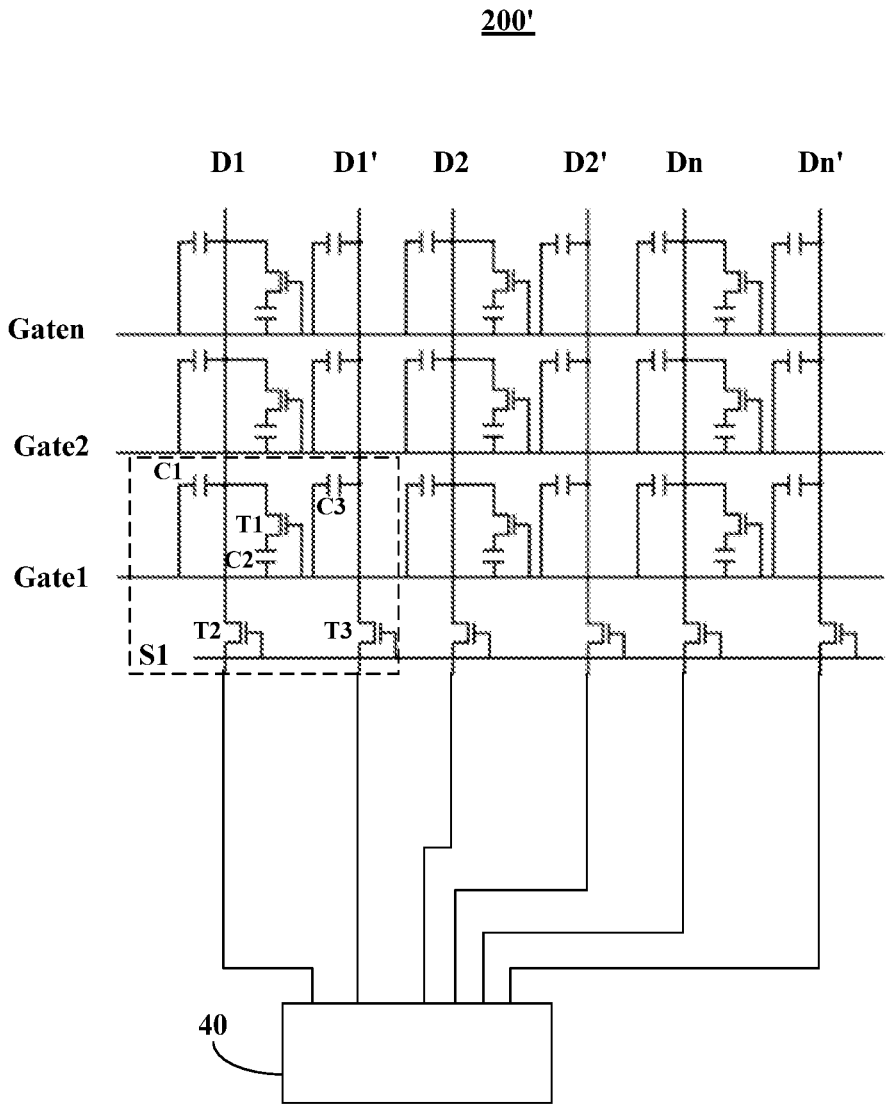
FIG. 4 shows a schematic circuit diagram of a signal line capacitance compensation circuit according to some other embodiments of the present disclosure.

FIG. 4 shows a signal line capacitance compensation circuit 200' according to some other embodiments of the present disclosure. In the above embodiments shown in FIG. 3, the compensation capacitances between any one control line and the gate lines are adjusted together. In the embodiments shown in FIG. 4, unlike the example of the signal line capacitance compensation circuit 200 shown in FIG. 3, the signal line capacitance compensation circuit 200' may adjust the compensation capacitances between the control line and the gate lines one-by-one to better optimize the consistency of compensating for the parasitic capacitance generated by each gate line. The signal line capacitance compensation circuit 200' in the embodiments shown in FIG. 4 is different from the embodiments shown in FIG. 3 above in that the structure of the compensation capacitances between the control line and the gate lines are more complicated.

Figure 5:
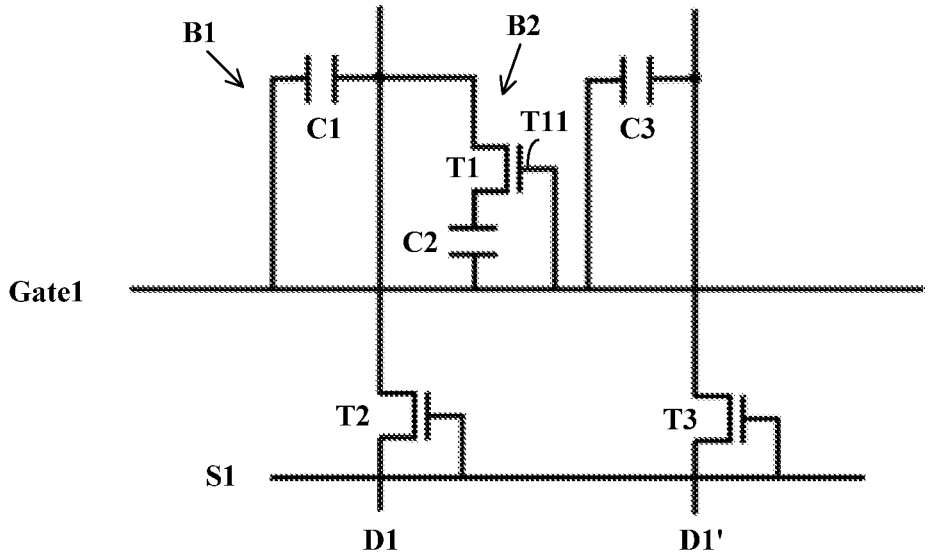
FIG. 5 shows a partial schematic diagram of the signal line capacitance compensation circuit shown in FIG. 4.

In order to better explain the signal line capacitance compensation circuit 200', FIG. 5 shows a partially enlarged schematic view of a portion, indicated by a dotted frame, of the signal line capacitance compensation circuit 200' shown in FIG. 4. In FIG. 5, two control lines (hereinafter referred to as a third control line D1 and a fourth control line D1') and one gate line Gate1 are shown. As shown in FIG. 5, a first branch B1 and a second branch B2 connected in parallel are provided between the third control line D1 and the gate line Gate1, and a first compensation capacitor C1 is provided in the first branch B1. The second branch B2 is provided with a branch switch T1 and a second compensation capacitor C2 connected in series. The control terminal T11 of the branch switch T1 is electrically connected to the gate line Gate1 and is configured to charge the second compensation capacitor C2 in response to a branch trigger signal from the gate line Gate1. In the signal line capacitance compensation circuit 200', the switching element includes a third control switch T2 configured to connect the third control line D1 in the closed state to charge the first compensation capacitor C1 and to disconnect the third control line D1 in the open state to stop charging the first compensation capacitor C1.

For the display panel, only when the gate line Gate1 is triggered (or when the gate line Gate1 is in the working state), the parasitic capacitance generated by the gate line Gate1 will affect the display. Therefore, in fact, it is only necessary to apply an appropriate voltage to the compensation capacitor between the control line and the gate line Gate1 when the gate line Gate1 is triggered. Therefore, in the embodiments, the control terminal T11 of the branch switch T1 is electrically connected to the gate line Gate1. When the gate line Gate1 is triggered by a gate driving circuit, a scan signal (e.g., a low level signal) will be generated on the gate line Gate1. In some embodiments, in order to simplify the control structure, the scan signal may be used as the branch trigger signal to close the branch switch T1. In this case, if the third control line D1 receives the charging signal from the above-mentioned signal source, the first compensation capacitor C1 and the second compensation capacitor C2 may be charged together, thereby achieving the capacitance compensation for the gate line Gate1. Of course, if it is not desired to perform capacitance compensation on the gate line Gate1, the charging signal may not be sent to the third control line D1. Taking the gate line progressive scan as an example, after the gate line Gate1 is scanned, the gate line Gate1 no longer has a scan signal (for example, maintains a high level) and the gate line Gate2 will generate a scan signal (for example, a low level signal), the second compensation capacitor C2 (also called controllable compensation capacitor) associated with the gate line Gate1 may maintain the original charging state. Referring to FIG. 4, it can be seen that, similar to the gate line Gate1, the first compensation capacitor, the second compensation capacitor, and the branch switch may also be provided for the gate line Gate2. In the case where the gate line Gate2 generates the scan signal, the capacitance compensation for the gate line Gate2 may be controlled in a manner similar to the manner of processing the gate line Gate1, and the specific details will not be repeated.

In some embodiments, the signal line capacitance compensation circuit 200' may further include a fourth control line D1' used in conjunction with the third control line D1. A third compensation capacitor C3 may be provided between the fourth control line D1' and the gate line Gate1. The signal source 40 is configured to send the charging signal to only one of the third control line D1 and the fourth control line D1' at a same moment. For example, the signal source 40 may be configured to send no charging signal to the fourth control line D1' while sending the charging signal to the third control line D1, and to send no charging signal to the third control line D1 while sending the charging signal to the fourth control line Dr. The third compensation capacitor C3 may be used to balance the capacitance compensation for the gate line Gate1.

Specifically, as shown in FIG. 5, when the third control line D1 receives the charging signal and the fourth control line D1' does not receive the charging signal, if the branch switch T1 is in the closed state, the third control line D1 charges both the first compensation capacitor C1 and the second compensation capacitor C2. When the third control line D1 does not receive the charging signal and the fourth control line D1' receives the charging signal, the fourth control line D1' charges the third compensation capacitor C3. Thus, between these two cases, the difference in the total capacitance value of the compensation capacitance between the third control line D1 and the fourth control line D1' as a whole and the gate line Gate1 is:

second compensation capacitor C2+(first compensation capacitor C1−third compensation capacitor C3).

In some embodiments, the capacitance value of the first compensation capacitor C1 may be set to be the same as the capacitance value of the third compensation capacitor C3, so that the change in the compensation capacitance between the third control line D1 and the fourth control line D1' as a whole and the gate line Gate1 is the capacitance compensation value of the second compensation capacitor C2. In the signal line capacitance compensation circuit 200' according to some embodiments of the present disclosure, a plurality of third control lines D1, D2, . . . , Dn and a plurality of fourth control lines D1', D2', . . . , Dn' may be provided, as shown in FIG. 4.

Figure 17:
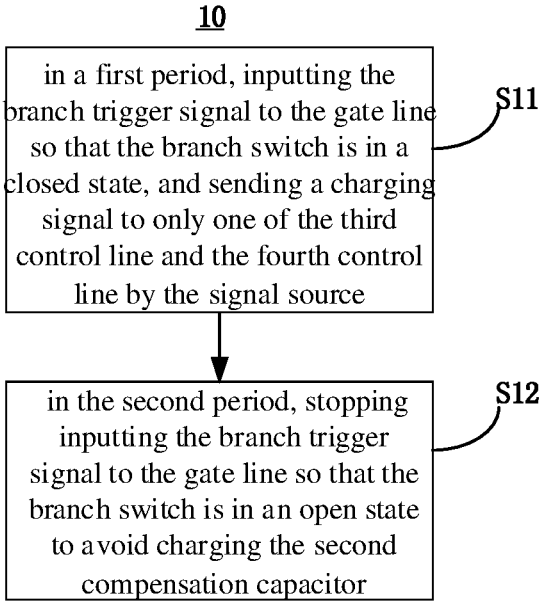
FIG. 17 shows a schematic view of a driving method of a signal line capacitance compensation circuit according to some further other embodiments of the present disclosure.

For the signal line capacitance compensation circuit 200' shown in FIG. 4, the present disclosure also provides an exemplary driving method 10. As shown in FIG. 17, the driving method 10 includes:

Step S11: in a first period, inputting the branch trigger signal to the gate line (such as the gate line Gate1) so that the branch switch is in the closed state, and sending a charging signal to only one of the third control line and the fourth control line by the signal source; and Step S12: in the second period, stopping inputting the branch trigger signal to the gate line (such as the gate line Gate1) so that the branch switch is in an open state to avoid charging the second compensation capacitor.

As described above, the first period may be regarded as a period when the gate line is scanned, or a working period of the gate line, and the second period may be regarded as a period when the gate line is not scanned, or a non-working period of the gate line. In some embodiments, in order to simplify the circuit design, the branch trigger signal may be directly implemented by the gate scan signal. For example, the branch trigger signal may be a high level signal or a low level signal. The signal source 40 is not limited to sending the charging signal for the third control line or the fourth control line only during the working period of the gate line, but it may also provide the charging signal for a longer period of time, as long as the time period during which the signal source 40 provides the charging signal may cover the working period of the gate line when capacitance compensation is required. In the above steps S11 and S12, only the driving process of performing capacitance compensation for a single gate line is given, and the capacitance compensation for more gate lines is to repeat the above steps S11 and S12 for each gate line. The specific process will not be repeated.

For the signal line capacitance compensation circuit 200 shown in FIG. 3, the driving method is relatively simple, as long as the signal source 40 sends the charging signal to the corresponding control line.

Figure 19:
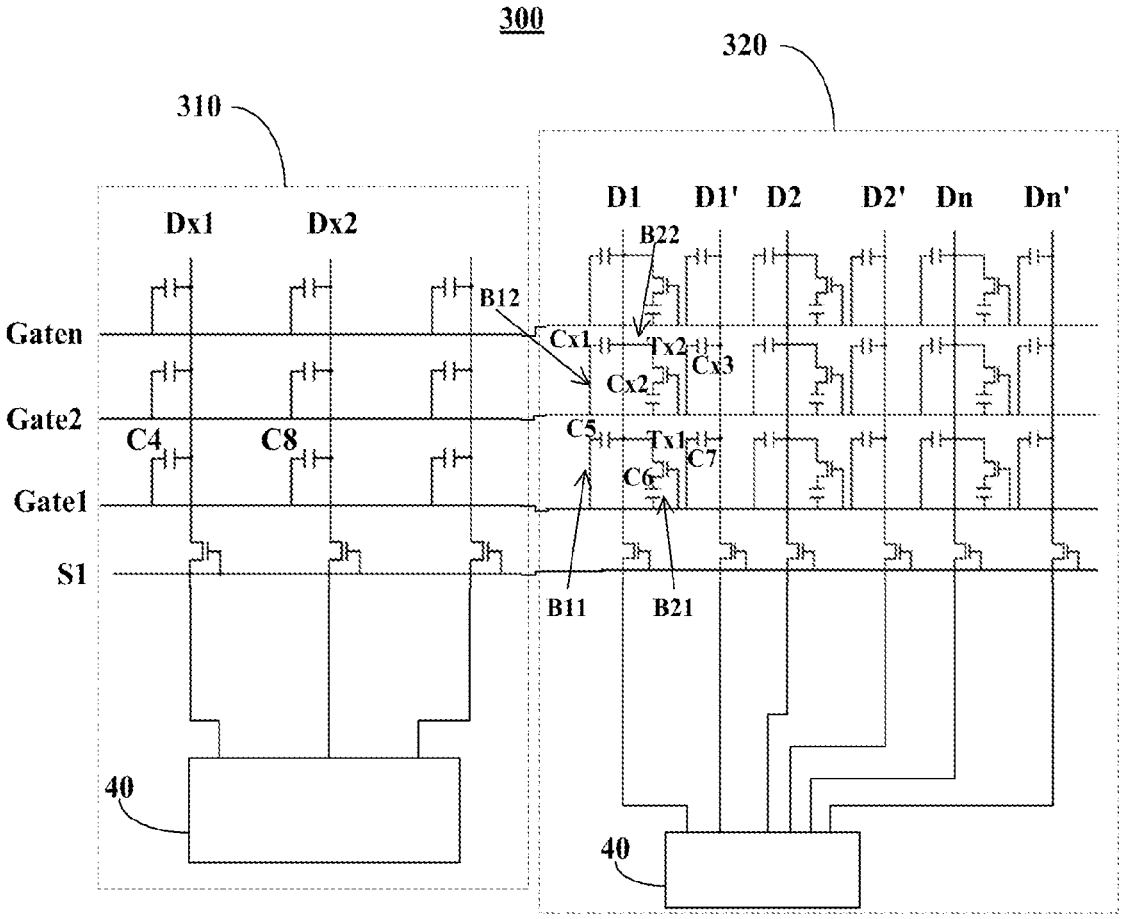
FIG. 19 shows a schematic diagram of a circuit module of a signal line capacitance compensation circuit according to some embodiments of the present disclosure.

In addition to the above-mentioned signal line capacitance compensation circuits 200, 200', some embodiments of the present disclosure also provides another signal line capacitance compensation circuit 300. As shown in FIGS. 2A and 19, it may include a combination of the above-mentioned signal capacitance compensation circuits 200, 200' and some other signal capacitance compensation circuits. For example, as shown in FIG. 2A, the signal line capacitance compensation circuit 300 may include a first signal line capacitance compensation sub-circuit 310 and a second signal line compensation sub-circuit 320. At least one of the first signal line capacitance compensation sub-circuit 310 and the second signal line compensation sub-circuit 320 is the signal line capacitance compensation circuit 200 or 200' according to any of the above embodiments. In the signal line capacitance compensation circuit 300, the first signal line capacitance compensation sub-circuit 310 and the second signal line compensation sub-circuit 320 share the gate lines. That is to say, the first signal line capacitance compensation sub-circuit 310 and the second signal line compensation sub-circuit 320 may perform capacitance compensation on the same group of gate lines, which may make the adjustment range of the compensation capacitance more free and provide greater flexibility for circuit design. In some embodiments, as shown in FIG. 19, the signal line capacitance compensation circuit 300 includes a plurality of gate lines Gate1, Gate2, . . . , Gaten. Taking the gate line Gate1 (also referred to as the first signal line) as an example, a fourth compensation capacitor C4 is formed between the first control line Dx1 and the gate line Gate1. A first branch B11 and a second branch B21 connected in parallel are provided between the third control line D1 and the gate line Gate1. The first branch B11 includes a fifth compensation capacitor C5, and the second branch B21 includes a branch switch Tx1 and a sixth compensation capacitor C6 connected in series. The control terminal of the branch switch Tx1 is electrically connected to the gate line Gate1. In the embodiments, the first control line Dx1 may adjust the compensation capacitance of the gate line Gate1 in the same manner as the control line in the signal line capacitance compensation circuit 200 shown in FIG. 3. The third control line D1 may adjust the compensation capacitance of the gate line Gate1 in the same manner as the control line in the signal line capacitance compensation circuit 200' shown in FIG. 4. The combined use of the above two types of circuit structures may further improve the effect of capacitance compensation on the gate line.

In some embodiments, the signal line capacitance compensation circuit 300 may further include a fourth control line D1' used in conjunction with the third control line D1. A seventh compensation capacitor C7 may be provided between the fourth control line D1' and the gate line Gate1. The signal source 40 is configured to send the charging signal to only one of the third control line D1 and the fourth control line D1' at a same moment. For example, the signal source 40 may be configured to send no charging signal to the fourth control line D1' while sending the charging signal to the third control line D1, and to send no charging signal to the third control line D1 while sending the charging signal to the fourth control line Dr. The seventh compensation capacitor C7 may be used to balance the capacitance compensation for the gate line Gate1. In some embodiments, the capacitance value of the fifth compensation capacitor C5 is the same as the capacitance value of the seventh compensation capacitor C7. The specific principles have already been introduced in the foregoing, and will not be repeated here.

In some embodiments, two different gate lines Gate1 and Gate2 (may be referred to as a first signal line Gate1 and a second signal line Gate2, respectively) may be considered. A fourth compensation capacitor C4 is formed between the first control line Dx1 and the gate line Gate1. A first branch B12 and a second branch B22 connected in parallel are provided between the third control line D1 and the gate line Gate2, The first branch B12 includes a first compensation capacitor Cx1. The second branch B22 includes a branch switch Tx2 and a second compensation capacitor Cx2 connected in series. The control terminal of the branch switch Tx2 is electrically connected to the gate Line Gate2. Similarly, considering the fourth control line D1', a third compensation capacitor Cx3 is provided between the fourth control line D1' and the gate line Gate2, and the signal source 40 is configured to send the charging signal to only one of the third control line D1 and the fourth control line D1' at a same moment. In some embodiments, the third compensation capacitor Cx3 may have the same capacitance value as the first compensation capacitor Cx1.

In some embodiments, for a same gate line, the compensation capacitors formed by different control lines and the same gate line may have different capacitance values. As shown in FIG. 19, an eighth compensation capacitor C8 is formed between the second control line Dx2 and the gate line Gate1. The capacitance value of the fourth compensation capacitor C4 formed between the first control line Dx1 and the gate line Gate1 is different from the capacitance value of the eighth compensation capacitor C8 formed between the second control line Dx2 and the gate line Gate1. This helps to perform different degrees of capacitance compensation for the gate line.

Figure 6:
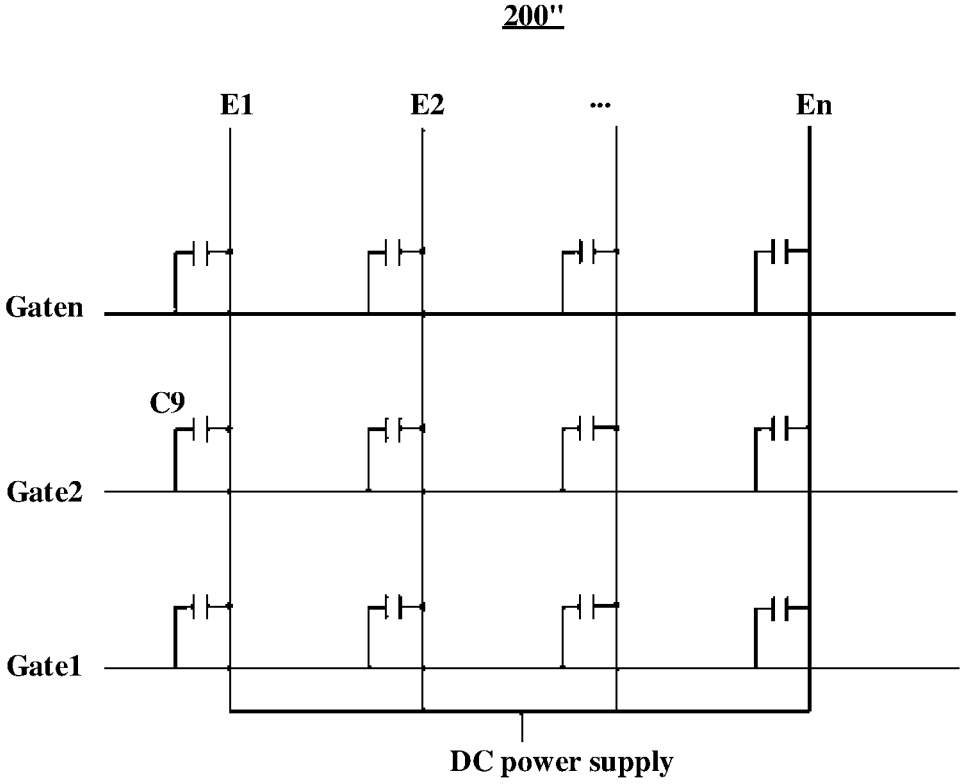
FIG. 6 shows a schematic circuit diagram of an exemplary fixed-capacitance compensation circuit.

FIG. 6 shows an example of another signal line capacitance compensation circuit 200". The signal line capacitance compensation circuit includes at least one capacitance compensation line E1, E2 . . . , En in addition to the gate lines Gate1, Gate2, . . . , Gaten. A ninth compensation capacitor C9 having a constant value is provided between the capacitance compensation lines E1, E2, . . . , En and at least one gate line Gate1, Gate2, . . . , Gaten. The ninth compensation capacitor C9 is always maintained in a charged state, for example, it may be achieved by connecting all the capacitance compensation lines E1, E2, . . . , En in parallel to the DC power supply. Since the signal line capacitance compensation circuit 200" has the fixed capacitance compensation value for each gate line, the signal line capacitance compensation circuit 200" may also be called a fixed-capacitance compensation circuit.

Figure 20:
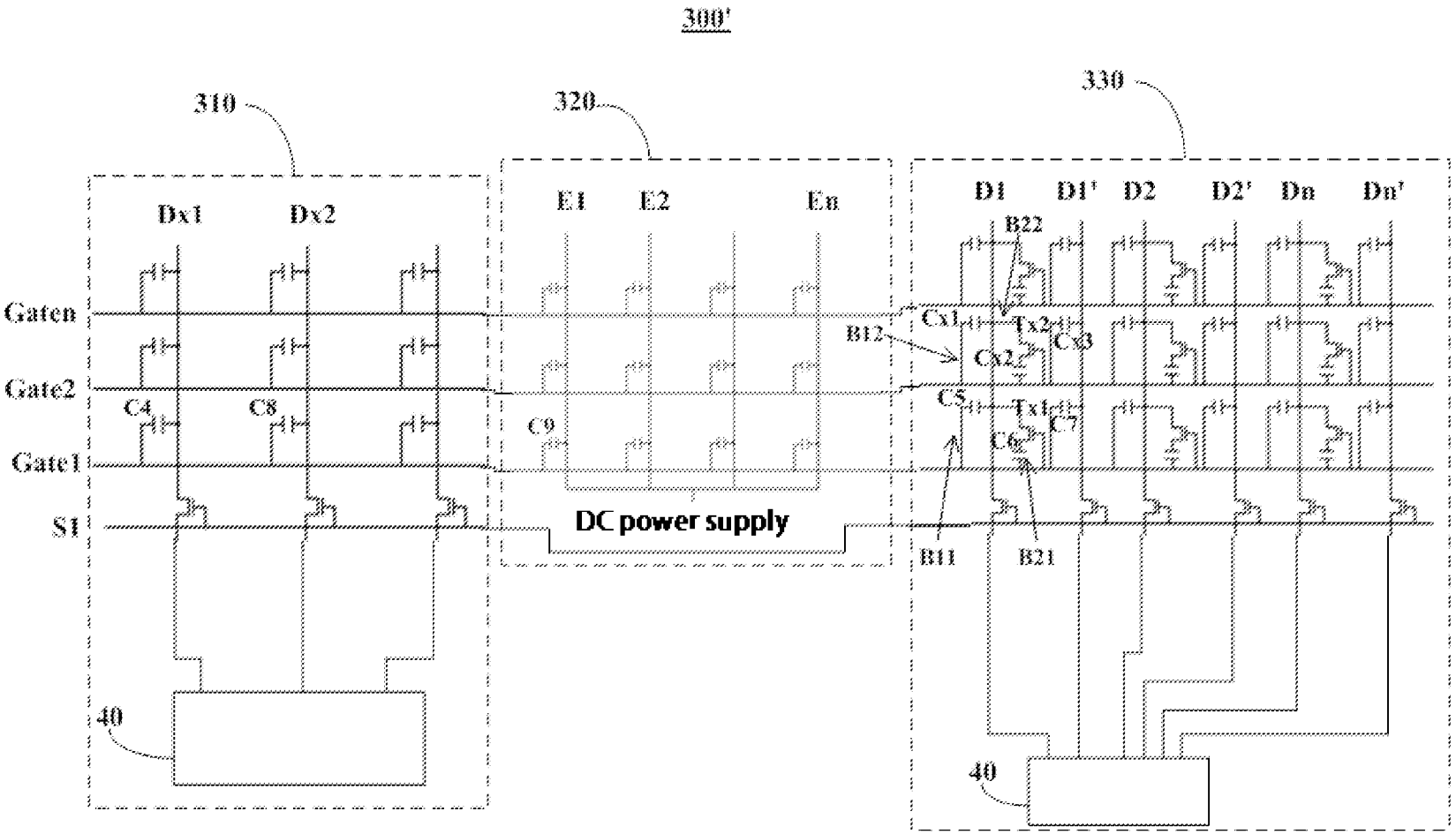
FIG. 20 shows a schematic diagram of a circuit module of a signal line capacitance compensation circuit according to some other embodiments of the present disclosure.

The signal line capacitance compensation circuit 200" may be used in combination with the above signal line capacitance compensation circuits 200, 200' to form a new signal line capacitance compensation circuit. For example, in the example shown in FIG. 20, compared with the signal line capacitance compensation circuit 300 shown in FIG. 19, the signal line capacitance compensation circuit 300' adds a circuit structure corresponding to the fixed-capacitance compensation circuit. That is, the signal line capacitance compensation circuit 300' further includes at least one capacitance compensation line E1, E2, . . . , En. A ninth compensation capacitor C9 having a constant value is provided between the capacitance compensation lines E1, E2, . . . , En and at least one gate line Gate1, Gate2, . . . , Gaten, and the ninth compensation capacitor C9 maintains a constant charged state. This may improve the stability of the compensation capacitor.

In some embodiments, as shown in FIGS. 2A and 20, the signal line capacitance compensation circuit 300' further includes a third signal line capacitance compensation sub-circuit 330 in addition to the first signal line capacitance compensation sub-circuit 310 and/or the second signal line compensation sub-circuit 320. The third signal line capacitance compensation sub-circuit 330, the first signal line capacitance compensation sub-circuit 310 and the second signal line compensation sub-circuit 320 share the same gate line or the same group of gate lines Gate1, Gate2, . . . , Gaten.

In the embodiments shown in FIG. 20, the first signal line capacitance compensation sub-circuit 310 and the third signal line capacitance compensation sub-circuit 330 each select a signal line capacitance compensation circuit with adjustable compensation capacitance value, and the second signal line capacitance compensation sub-circuit 320 selects a fixed-capacitance compensation circuit. However, this is only exemplary, and the embodiments of the present disclosure are not limited thereto. The fixed-capacitance compensation sub-circuit may be used as any one of the first signal line capacitance compensation sub-circuit 310, the second signal line capacitance compensation circuit 320, and the third signal line capacitance compensation sub-circuits 330, as long as the signal line capacitance compensation circuit 300' may include at least one signal line capacitance compensation sub-circuit with adjustable compensation capacitance value.

In the signal line capacitance compensation circuit 300', in addition to the signal line capacitance compensation sub-circuit with adjustable compensation capacitance value, the fixed-capacitance compensation circuit is also provided to improve the stability of the compensation capacitance.

It should be noted that, in the above-mentioned signal line capacitance compensation circuits 300 and 300', different signal line capacitance compensation circuits may use their own signal sources or a common signal source.

FIG. 2A shows that an exemplary signal line capacitance compensation circuit 300' is provided in the signal line capacitance compensation area 31. The signal line capacitance compensation circuit 300' includes a first signal line capacitance compensation sub-circuit 310 on the left, a second signal line capacitance compensation sub-circuit 320 in the middle, and a third signal line capacitance compensation sub-circuit 330 on the right. In some embodiments, a total rated value of capacitance compensation of the signal line capacitance compensation circuit 300' for all the gate lines (i.e., a total capacitance compensation value expected to be compensated for all the gate lines, which may be determined according to theoretical calculations or actual experiments) may be distributed among the first signal line capacitance compensation sub-circuit 310, the second signal line capacitance compensation sub-circuit 320, and the third signal line capacitance compensation sub-circuit 330. For example, the second signal line capacitance compensation sub-circuit 320 may be a fixed-capacitance compensation circuit whose capacitance compensation value may occupy 75% of the total rated value of capacitance compensation. The first signal line capacitance compensation sub-circuit 310 and the third signal line capacitance compensation sub-circuit 330 may be signal line capacitance compensation circuits with an adjustable compensation capacitance value, and the maximum value of the capacitance compensation value of each capacitance compensation circuit of them is 20% to 25% of the total rated value of the capacitance compensation. In this case, the actual capacitance compensation value of the signal line capacitance compensation circuit 300' for all gate lines may vary from 75% to 125% (or 115% or 120%) of total rated value of the capacitance compensation. This not only ensures that the actual total value of the capacitance compensation can be adjusted within a larger range, but also ensures the stability of the total capacitance compensation value (that is, it will not change too much).

In some embodiments, the signal line capacitance compensation circuit 300' may include any combination of the signal line capacitance compensation sub-circuits according to the foregoing embodiments. For example, the first signal line capacitance compensation sub-circuit 310 and the third signal line capacitance compensation sub-circuit 330 may each be the signal line capacitance compensation circuit 200 shown in FIG. 3 or the signal line capacitance compensation circuit 200' shown in FIG. 4, or other similar structures. The structures of the first signal line capacitance compensation sub-circuit 310 and the third signal line capacitance compensation sub-circuit 330 may be the same or different.

Embodiments of the present disclosure may also include a display panel having the above-mentioned signal line capacitance compensation circuit.

The specific structure of the signal line capacitance compensation circuit on the display panel will be described in detail below.

Figure 7:
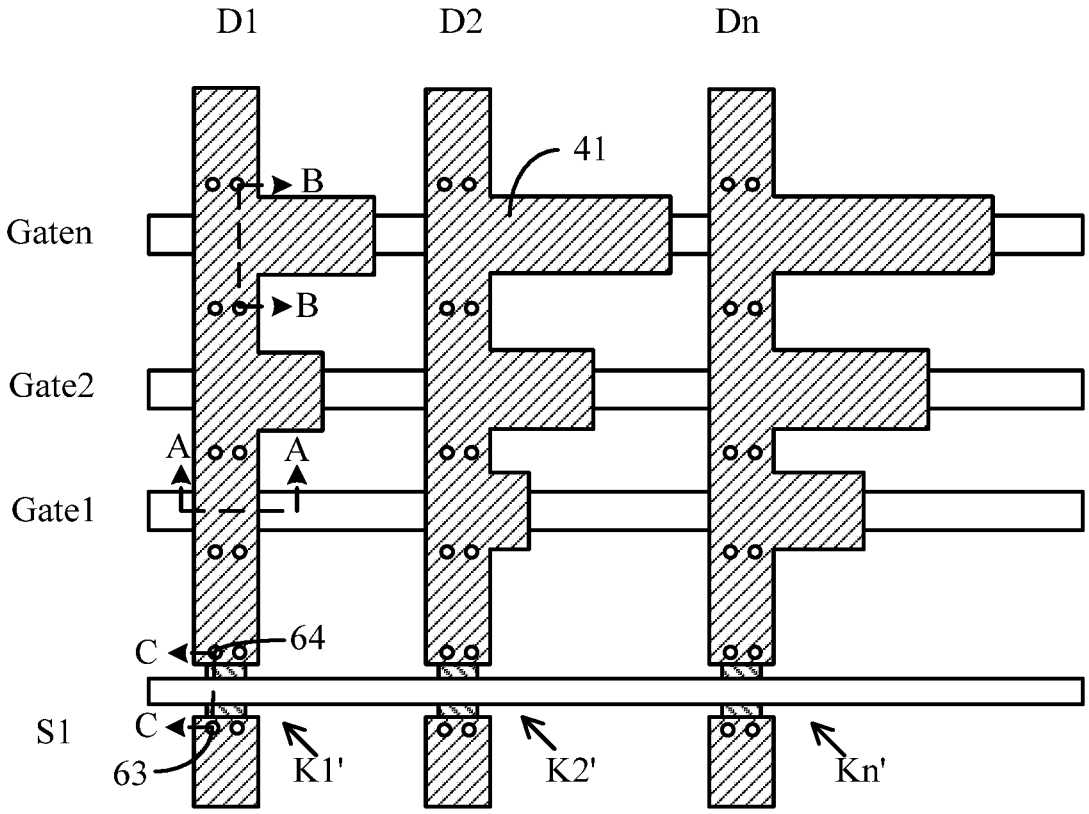
FIG. 7 shows a schematic structural view of a signal line capacitance compensation circuit according to some embodiments of the present disclosure.
Figure 8A:
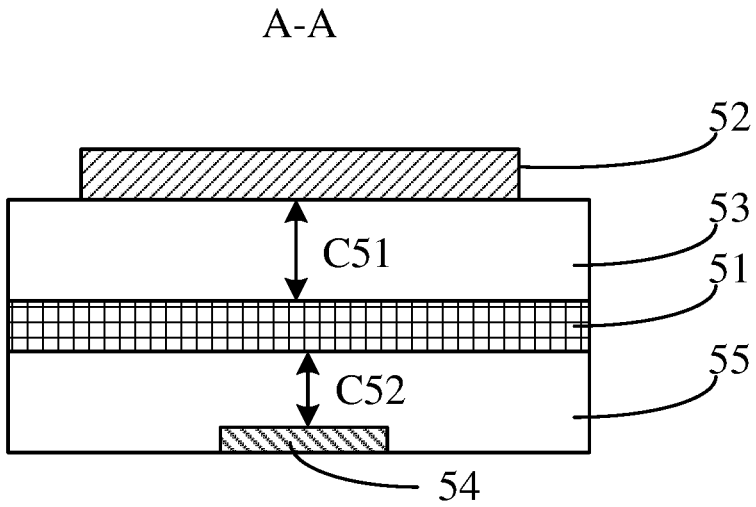
FIGS. 8A, 8B, and 8C show an AA cross-sectional view, a BB cross-sectional view, and a CC cross-sectional view of the structure shown in FIG. 7, respectively.
Figure 8B:
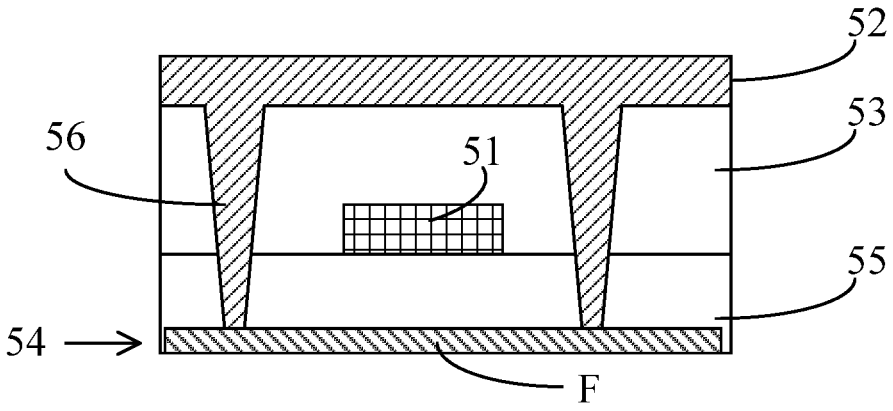

FIG. 7 shows a physical structure view generally corresponding to the signal line capacitance compensation circuit 200 shown in FIG. 3. In order to clearly show the physical structure, FIG. 7 only shows a top view of the conductive layer and the active layer on the substrate, and does not show the insulating layer. In FIG. 8A (cross-sectional view taken along line AA in FIG. 7) and FIG. 8B (cross-sectional view taken along line BB in FIG. 7), the insulating layer is used to illustrate the interlayer relationship between the conductive layers. As can be seen from FIGS. 7 and 8A and 8B, the signal line capacitance compensation area 31 is provided with a signal line layer 51 and a control line layer 52. A plurality of gate lines Gate1, Gate2, . . . , Gaten are provided in the signal line layer 51. At least one control line D1, D2, . . . , Dn is provided in the control line layer 52. The signal line layer 51 and the control line layer 52 are separated by a first insulating layer 53. At least one control line D1, D2, . . . , Dn overlaps the gate lines Gate1, Gate2, . . . , Gaten to form a compensation capacitor at the overlapping portion of the control line and the gate line. For the signal source 40, for example, it may be implemented by an integrated circuit or the like, and may or may not be provided in the signal line capacitance compensation area 31, which is not shown in FIG. 7.

It can be seen from FIG. 7 that for the same gate line Gate1, Gate2, . . . , Gaten, overlapping areas of different control lines and it may be different. This can be achieved, for example, by providing different extensions 41 in the control lines D1, D2, . . . , Dn. Since the compensation capacitance between the control line and the gate line is proportional to their overlapping area, this design can be used to realize that different control lines have different capacitance compensation values for the gate line. Similarly, the overlapping areas of the same control line and different gate lines may also be different. For example, in the case where it is desired to design the capacitance compensation value to decrease sequentially from the gate line Gaten to the gate line Gate1 as described above, the overlapping areas of the same control line and the gate line Gaten to the gate line Gate1 may sequentially decrease, as shown in FIG. 7.

In some embodiments, the signal line capacitance compensation area 31 further includes a control line expansion layer 54. The control line expansion layer 54 is located on a side of the signal line layer 51 facing away from the control line layer 52 and separated from the signal line layer 51 by a second insulating layer 55. The control line expansion layer 54 is provided with at least one expansion control line F, and each expansion control line F is electrically connected with at least one control line D1, D2, . . . Dn in the control line layer 52 via a conductive path (such as a via hole) 56. The extension control line F overlaps at least one gate line Gate1, Gate2, . . . , Gaten in the signal line layer 51. In this case, the expansion control line F may be regarded as an extension of the control line D1, D2, . . . , Dn electrically connected thereto. The compensation capacitor will be formed by the gate line and the expansion control line F and the control line D1, D2, . . . , Dn electrically connected thereto. Therefore, the compensation capacitor can be regarded as including a first sub-compensation capacitor C51 and a second sub-compensation capacitor C52. The first sub-compensation capacitor C51 may be formed by an overlapping portion of the control line D1, D2, . . . , Dn and the gate line, and the second sub-compensation capacitor C52 may be formed by an overlapping portion of the expansion control line F and the gate line Gate1, Gate2, Gaten. The second sub-compensation capacitor C52 and the first sub-compensation capacitor C51 are actually connected in parallel. By providing the control line expansion layer 54, capacitors may be formed on the upper and lower sides of the gate line, and the capacitors on the upper and lower sides of the gate line are connected in parallel with each other. In this way, in the case of obtaining the same compensation capacitance value, the overlapping area of the control line D1, D2, . . . , Dn and the gate line Gate1, Gate2, . . . , Gaten may be reduced, thereby providing more space for the structural design of the panel.

In some embodiments, the signal line capacitance compensation area 31 may also be provided with a switching element that connects the at least one control line in a closed state to turn on the path of the signal source 40 to the compensation capacitor and disconnects the at least one control line in an open state to turn off the path of the signal source 40 to the compensation capacitor.

Figure 8C:
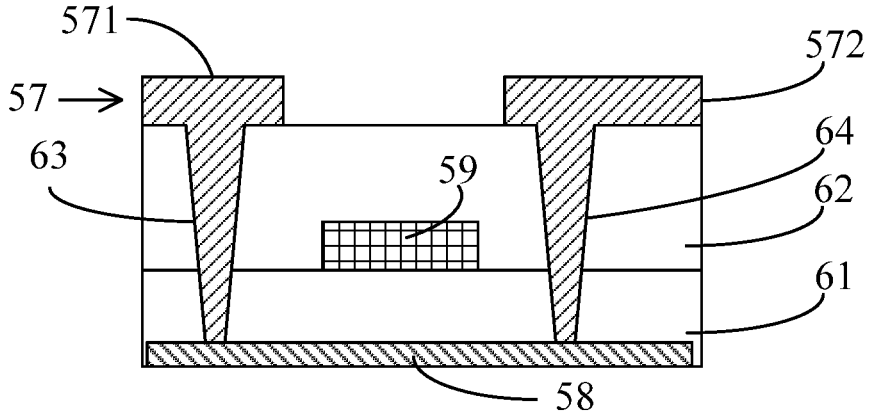

The switching element may include, for example, a plurality of thin film transistors K1', K2', . . . , Kn'. As shown in FIG. 8C, each thin film transistor K1', K2', . . . , Kn' includes: a source electrode 571 and a drain electrode 572 in a source-drain layer 57, an active layer 58; a gate electrode 59 between the source-drain layer 57 and the active layer 58; a first insulating layer 61 (for example, a gate insulating layer) between the active layer 58 and the gate electrode 59; and a second insulating layer 62 between the source-drain layer 57 and the gate electrode 59. In order to simplify the film structure on the display panel, the source electrode 571 and the drain electrode 572 may be provided in the same layer as the control lines D1, D2, . . . , Dn, and the gate electrode 59 of the thin film transistor constituting the switching element may be provided in the same layer as the gate lines Gate1, Gate2, . . . , Gaten. The source electrode 571 and the drain electrode 572 are electrically connected to the active layer 58 via conductive paths 63 and 64 passing through the first insulating layer 61 and the second insulating layer 62, respectively.

Figure 9:
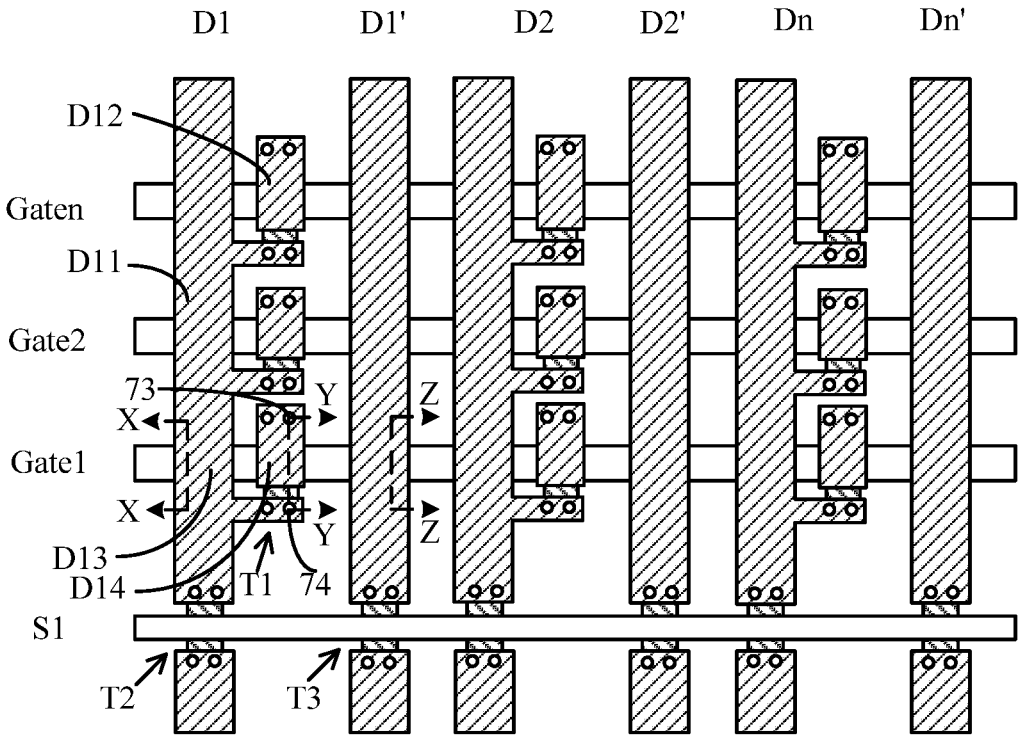
FIG. 9 shows a schematic structural view of a signal line capacitance compensation circuit according to some other embodiments of the present disclosure.
Figure 10A:
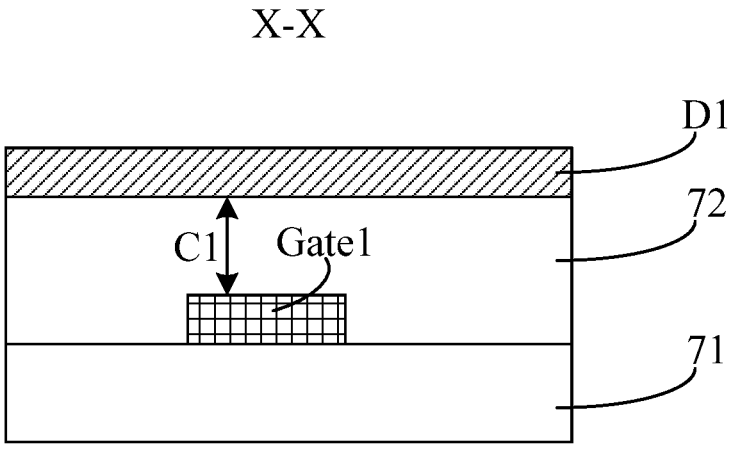
FIGS. 10A, 10B, and 10C show an XX cross-sectional view, a YY cross-sectional view, and a ZZ cross-sectional view of the structure shown in FIG. 9, respectively.
Figure 10B:
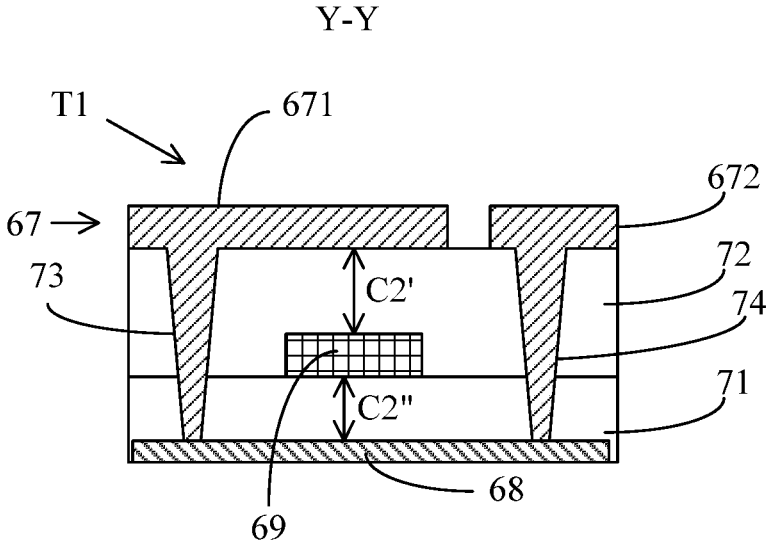
Figure 10C:
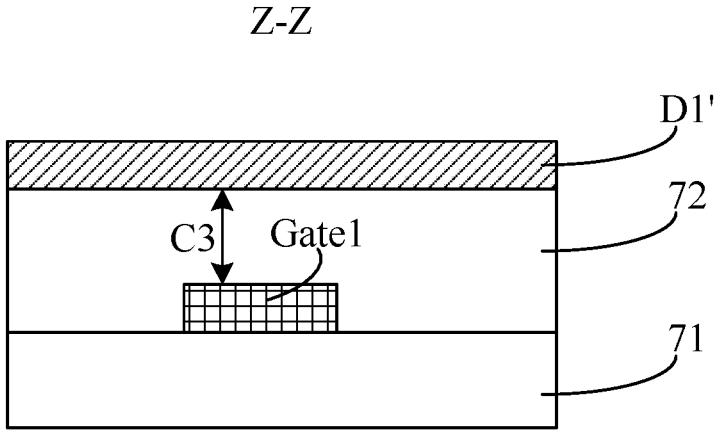
Figure 11:
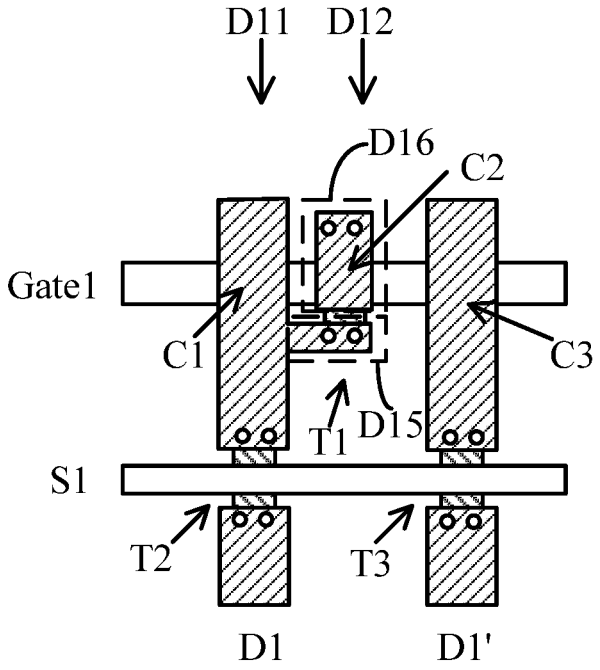
FIG. 11 shows a partial schematic view of the structure shown in FIG. 9.

FIG. 9 shows a physical structure diagram generally corresponding to the signal line capacitance compensation circuit 200' shown in FIG. 4. FIGS. 10A, 10B, and 10C are a XX cross-sectional view, a YY cross-sectional view, and a ZZ cross-sectional view of FIG. 9, respectively. FIG. 11 shows a partially enlarged view of FIG. 9, in which only one gate line Gate1 is shown. A third control line D1 is shown in FIG. 9, and the third control line D1 has a trunk portion D11 and a plurality of branch portions D12 extending from the trunk portion D11. The trunk portion D11 includes a first overlapping portion D13 overlapping the gate line Gate1. One of the plurality of branch portions D12 includes a second overlapping portion D14 overlapping the gate line Gate1, and the second overlapping portion D14 and the first overlapping portion D13 are spaced apart from each other. As can be seen from FIG. 10A, the first compensation capacitor C1 is formed between the first overlapping portion D13 of the trunk portion D11 and the gate line Gate1, the trunk portion D11 and the gate line Gate1 are separated by the second insulating layer 72. In some embodiments, the second compensation capacitor C2 is formed between the second overlapping portion D14 of the branch portion D12 and the gate line Gate1. As described above, the second compensation capacitor C2 may be used to adjust the capacitance compensation value of the single gate line Gate1.

In some embodiments, a branch switch T1 may also be provided in the signal line capacitance compensation area 31. In the case where the branch switch T1 is provided, each branch portion D12 includes a first portion D15 connected to the trunk portion D11 and a second portion D16 including the second overlapping portion D13 (indicated by dotted frames in FIG. 11, respectively). The branch switch T1 is configured to electrically connect or disconnect the first portion D15 and the second portion D16 of the branch portion D12 in response to a branch trigger signal from the gate line Gate1, so that the trunk portion D11 is electrically connected to or disconnected from the second overlapping portion D14. In some embodiments, the branch switch T1 may include a thin film transistor. As can be seen from FIG. 10B, the thin film transistor includes: a source electrode 671 and a drain electrode 672 disposed in a source-drain layer 67; an active layer 68; and a gate electrode 69 between the source-drain layer 67 and the active layer 68; a first insulating layer 71 between the active layer 68 and the gate electrode 69; and a second insulating layer 72 between the source-drain layer 67 and the gate electrode 69. In order to simplify the film structure on the display panel, the source electrode 671 and the drain electrode 672 are arranged in the same layer as the third control line D1, the gate electrode 69 is arranged in the same layer as the gate line Gate1, and the gate electrode 69 is electrically connected to the gate line Gate1. The source electrode 671 and the drain electrode 672 are electrically connected to the active layer 68 via conductive paths 73 and 74 passing through the first insulating layer 71 and the second insulating layer 72, respectively. To further simplify the structure, for example, as can be seen from FIG. 10B, the branch portion D12 of the third control line D1 may be used as the drain electrode 672 of the thin film transistor of the branch switch T1, and the gate line Gate1 may be used as the gate electrode 69 of the branch switch T1. A third sub-compensation capacitor CT is formed between an upper side of the gate electrode 69 of the thin film transistor of the branch switch T1 and the drain electrode 672, and a fourth sub-compensation capacitor C2" is formed between the lower side of the gate electrode 69 of the thin film transistor of the branch switch T1 and the active layer 68. Since The third sub-compensation capacitor CT and the fourth sub-compensation capacitor C2" are in a parallel relationship, the capacitance value of the second compensation capacitor C2 formed between the branch portion D12 and the gate line Gate1 is actually the sum of the capacitance values of the third sub-compensation capacitor CT and the fourth sub-compensation capacitor C2". This design combines the double-layer capacitance compensation structure with the branch switch structure, making full use of the space on the display panel, which is beneficial to simplify the structure and increase the design space.

In some embodiments, a fourth control line D1' may also be provided in the signal line capacitance compensation area 31, as shown in FIGS. 9 and 10C. The fourth control line D1' has a third overlapping portion D11' overlapping the gate line Gate1. As can be seen from FIG. 10C, a third compensation capacitor C3 is formed between the third overlapping portion D11' of the fourth control line D1' and the gate line Gate1, and the fourth control line D1' and the gate line Gate1 are separated by the second insulating layer 72. As mentioned above, the design of the fourth control line D1' and the third compensation capacitor C3 is beneficial for balancing the compensation capacitor of the third control line D1 and improving the stability of the capacitance compensation circuit.

In some embodiments, the area of the third overlapping portion D11' is the same as the area of the first overlapping portion D13, so that the capacitance value of the third compensation capacitor C3 formed between the third overlapping portion D11' of the fourth control line D1' and the gate line Gate1 is equal to the capacitance value of the first compensation capacitor C1 formed between the first overlapping portion D13 of the trunk portion D11 of the third control line D1 and the gate line Gate1. As mentioned above, the capacitance value of the third compensation capacitor C3 is equal to the capacitance value of the first compensation capacitor C1, so that the adjustment amount of the compensation capacitance for a single gate line Gate1 is exactly equal to the capacitance value of the second compensation capacitor, which is beneficial to the precise adjustment of the capacitance compensation amount of the gate line.

Figure 12:
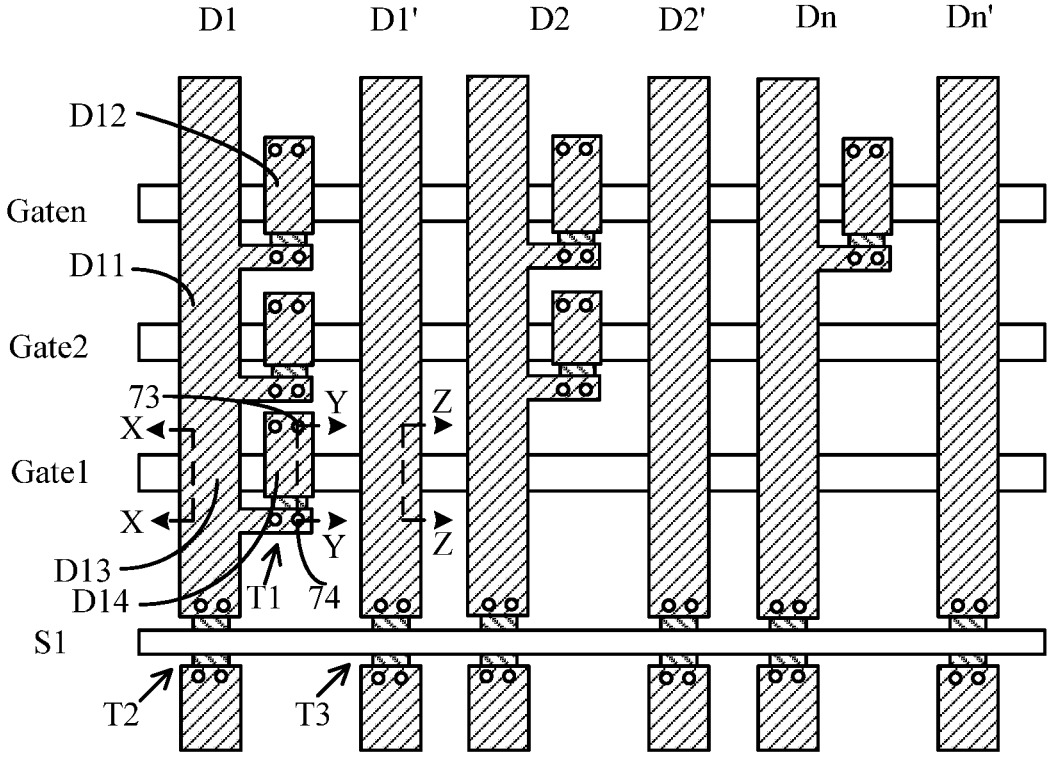
FIG. 12 shows a schematic structural view of a signal line capacitance compensation circuit according to some other embodiments of the present disclosure.

In the signal line capacitance compensation circuit 200' shown in FIG. 9, the same number of second compensation capacitors C2 are provided for each gate line Gate1, Gate2, . . . , Gaten, however, the embodiments of the present disclosure are not limited thereto. For example, the signal line capacitance compensation circuit may also be provided with a different number of second compensation capacitors C2 for each gate line Gate1, Gate2, . . . , Gaten, or in other words, in the case where a plurality of control lines D1, D2, . . . , Dn with branch portions are provided in the signal line capacitance compensation circuit 200', the number of branch portions of each control line D1, D2, . . . , Dn is different, for example, as shown in FIG. 12. In some embodiments, the signal line capacitance compensation circuit may be set such that the number of second compensation capacitors provided for each gate line Gate1, Gate2, . . . , Gaten decreases or increases in sequence. It may be selected according to factors such as the wiring direction and length of each gate line Gate1, Gate2, . . . , Gaten.

Figure 13A:
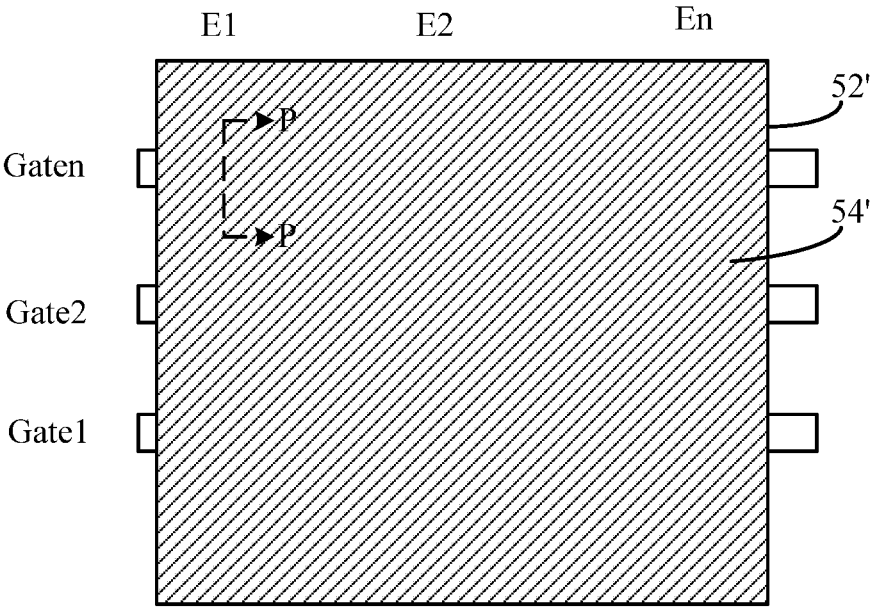
FIG. 13A shows a schematic structural view of an exemplary fixed-capacitance compensation circuit.

FIG. 13A shows a schematic physical structure view of the aforementioned fixed-capacitance compensation circuit. The fixed-capacitance compensation circuit includes one or more capacitance compensation lines E1, E2, . . . , En. A fourth compensation capacitor having a constant capacitance value is formed between the capacitance compensation lines E1, E2, . . . , En and the gate lines Gate1, Gate2, . . . , Gaten, respectively. The capacitance compensation lines E1, E2, . . . , En and the gate lines Gate1, Gate2, . . . , Gaten are separated from each other by an insulating layer. In some embodiments, the capacitance compensation lines E1, E2, . . . , En may be provided only on one side of the gate lines Gate1, Gate2, . . . , Gaten to form the fourth compensation capacitor. A structure similar to that shown in FIGS. 8A and 8B may also be used, and sub-compensation capacitors in parallel are formed on both sides of the gate lines Gate1, Gate2, . . . , Gaten to save space and simplify the circuit structure.

Figure 13B:
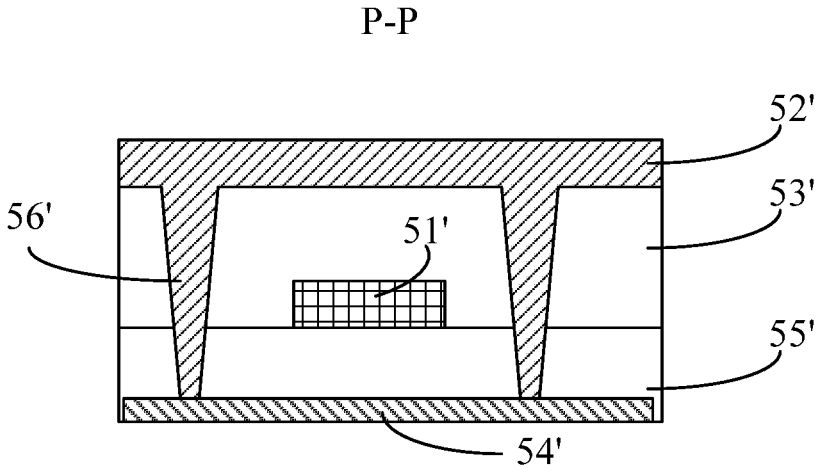
FIG. 13B shows a PP cross-sectional view of the structure shown in FIG. 13A.

FIG. 13B shows a PP cross-sectional view of the exemplary structure shown in FIG. 13A. The fixed-capacitance compensation circuit is provided with a signal line layer 51', a capacitance compensation line layer 54', and a capacitance compensation line expansion layer 52'. The signal line layer 51' is provided with a plurality of gate lines Gate1, Gate2, . . . , Gaten. The capacitance compensation lines layer 54' are provided with capacitance compensation lines E1, E2, . . . , En. The signal line layer 51' and the capacitance compensation line layer 54' are separated by a first insulating layer 53'. The capacitance compensation line expansion layer 52' is located on a side of the signal line layer 51' facing away from the capacitance compensation line layer 54' and is separated from the signal line layer 51' by a second insulating layer 55'. The capacitance compensation line expansion layer 52' is electrically connected to the capacitance compensation lines E1, E2, . . . , En in the capacitance compensation line layer 54' through conductive paths (e.g., via holes) 56'. Similar to the previous structure in FIGS. 8A and 8B, with this structure, capacitors can be formed on the upper and lower sides of the gate line, and the capacitors on the upper and lower sides of the gate line are parallel to each other. In this way, in the case of obtaining the same compensation capacitance value, the overlapping area of the control line D1, D2, . . . , Dn and the gate line Gate1, Gate2, . . . , Gaten may be reduced, thereby providing more space for the structural design of the panel. In some embodiments, the positions of the capacitive compensation line layer 54' and the capacitance compensation line expansion layer 52' may be interchanged. In addition, in order to enhance the stability of the signal, the capacitance compensation line expansion layer 52' may be formed in a planar form as shown in FIG. 13A. The circles in FIGS. 7, 9 and 13A all indicate the positions of conductive paths, such as via holes. In order to clearly show the structure covered by the capacitance compensation line expansion layer 52', the capacitance compensation line expansion layer 52' in FIG. 13A is shown in a translucent form. Those skilled in the art should understand that, in practice, the capacitance compensation line expansion layer 52' may be opaque.

Figure 14:
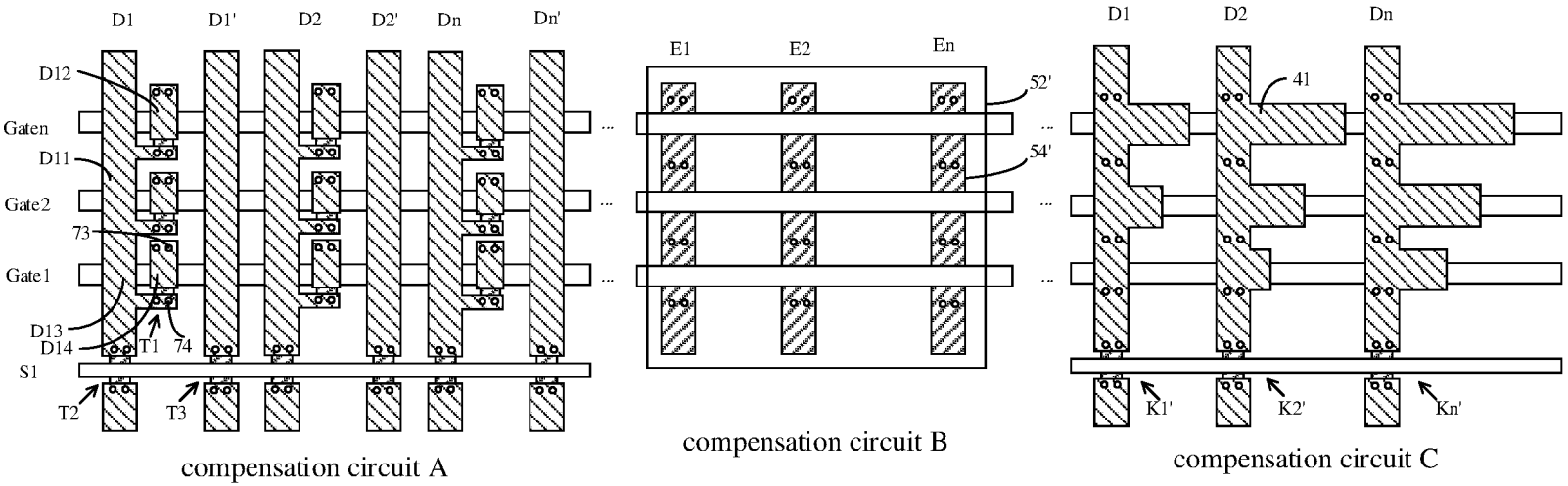
FIG. 14 shows a schematic view of a signal line capacitance compensation circuit according to yet some other embodiments of the present disclosure.
Figure 15:
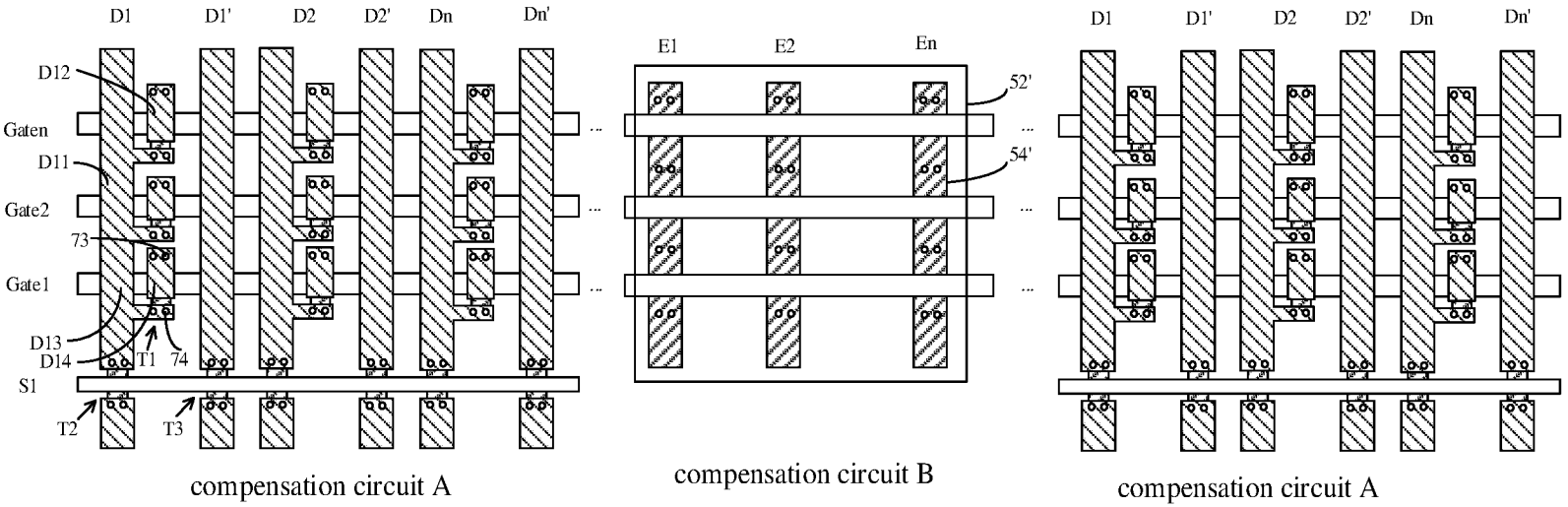
FIG. 15 shows a schematic view of a signal line capacitance compensation circuit according to still some other embodiments of the present disclosure.
Figure 16:
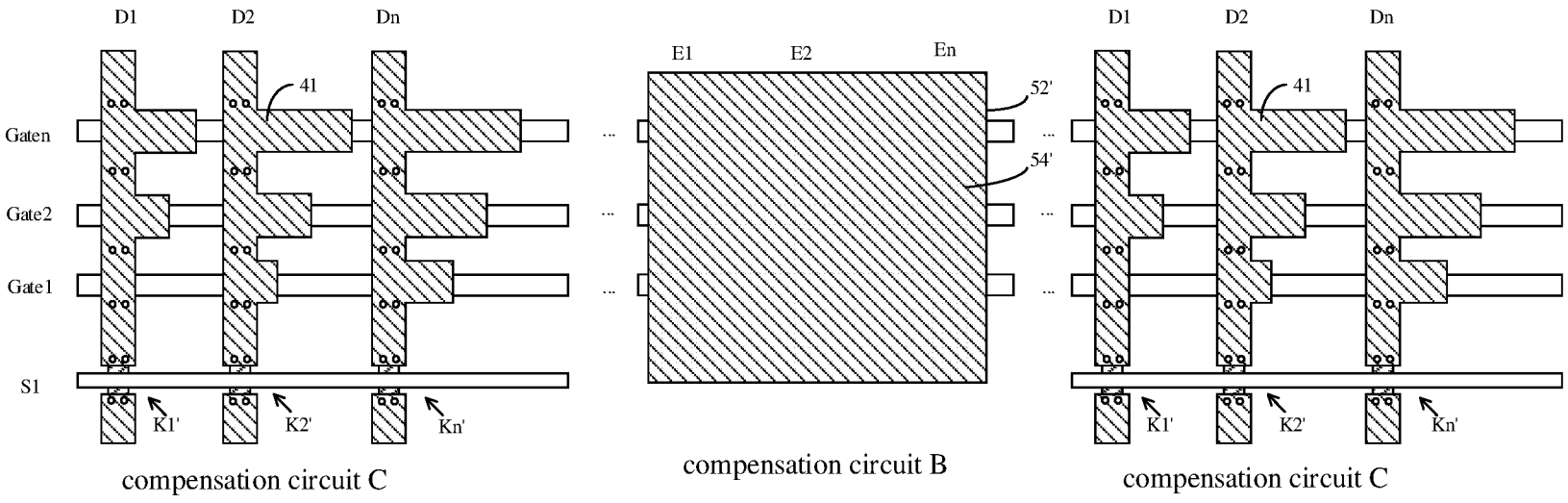
FIG. 16 shows a schematic view of a signal line capacitance compensation circuit according to yet still some other embodiments of the present disclosure.

FIGS. 14 to 16 show combinations of several signal line capacitance compensation circuits in the signal line capacitance compensation circuit. In the exemplary signal line capacitance compensation circuit shown in FIG. 14, three signal line capacitance compensation sub-circuits with different structures are included. The three signal line capacitance compensation sub-circuits with different structures correspond to the signal line capacitance compensation circuit 200' (hereinafter referred to as compensation circuit A) shown in FIGS. 4 and 9, the above-mentioned fixed-capacitance compensation circuit (hereinafter referred to as compensation circuit B) shown in FIGS. 5 and 13A, and the signal line capacitance compensation circuit 200 (hereinafter referred to as compensation circuit C) shown in FIGS. 3 and 7, respectively. In the signal line capacitance compensation circuit according to the embodiments of the present disclosure, various signal line capacitance compensation circuits may be freely combined. A combination of the compensation circuit A, the compensation circuit B, and the compensation circuit A is shown in FIG. 15, and a combination of the compensation circuit C, the compensation circuit B, and the compensation circuit C is shown in FIG. 16. However, the embodiments of the present disclosure are not limited to these, for example, the signal line capacitance compensation circuit may include only a combination of the compensation circuit B and the compensation circuit A or a combination of the compensation circuit B and the compensation circuit C or a similar combination of capacitance compensation circuits. This may realize the modular design of the signal line capacitance compensation circuit.

Figure 18:
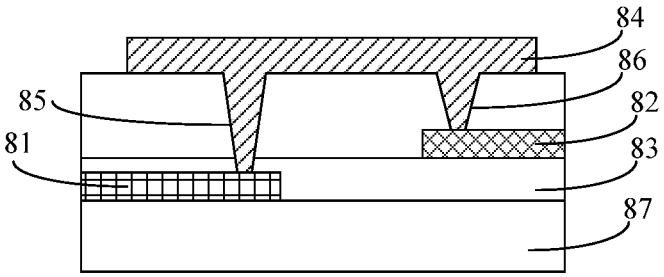
FIG. 18 shows a layer jump structure of a gate layer between a fixed-capacitance compensation area and a controllable capacitance compensation area in a signal line capacitance compensation circuit according to some embodiments of the present disclosure.

FIG. 18 shows an example of a transition design of the gate line between the compensation circuit A and the compensation circuit B in the signal line capacitance compensation circuit including the combination of the compensation circuit A and the compensation circuit B. As described above, in the compensation circuit A, in order to form the second compensation capacitor C2 between the branch portion of the third control line and the gate line, it is necessary to form the branch switch T1. In an example, as shown in FIG. 10B, the branch switch T1 may be formed of a thin film transistor (TFT), and the thin film transistor is constructed based on the gate line. The production of TFT itself requires a doping process. Since the compensation circuit B does not require a TFT structure, the doping process only needs to be performed in the compensation circuit A. To facilitate the doping process, the gate line of the compensation circuit A may be formed in a first gate layer 81, and the gate line of the compensation circuit B may be formed in a second gate layer 82, the first gate layer 81 and the second gate layer 82 are separated by an additional gate insulating layer 83. The first gate layer 81 and the second gate layer 82 can be electrically connected by a conductive transition structure. In some embodiments, the transition structure may include an intermediate connection layer 84, and a first conductive path 85 connecting the first gate layer 81 and the intermediate connection layer 84, and a second conductive path 86 connecting the second gate layer 82 and the intermediate connection layer 84. In some embodiments, a gate insulating layer 87 may be further provided in a side of the first gate layer 81 facing away from the second gate layer 82, for separating the first gate layer 81 from other film layers not shown (such as metal layer, active layer, etc.). For example, the intermediate connection layer 84 may be provided in the same layer as the source-drain layer of the branch switch T1. Similarly, when the gate line is switched between the compensation circuit A and the compensation circuit C, the above structure may also be adopted. However, the design of the above transition structure is only exemplary, and the embodiments of the present disclosure are not limited thereto.

The "same layer arrangement" referred to in the present disclosure means that the layers involved are simultaneously formed in the same process step, and does not mean that the layers must have the same thickness or height in the cross-sectional view.

The display panel in the embodiments of the present disclosure may be, for example, any display panel known in the art, such as an organic light emitting diode (OLED) display panel, a liquid crystal display panel, or the like.

In the embodiments of the present disclosure, although the gate lines are taken as an example to introduce the signal line capacitance compensation circuit, those skilled in the art should understand that the signal line capacitance compensation circuit is not limited to compensating the consistency of the parasitic capacitance generated by the gate lines, but may also be used to compensate the consistency of the parasitic capacitance generated by other signal lines (such as data lines, etc.) on the display panel.

In the embodiments of the present disclosure, the numbers of the plurality of gate lines Gate1, Gate2, . . . , Gaten, the plurality of control lines D1, D2, . . . , Dn, the data lines Data1, Data2, . . . , Datan, and the plurality of control switches K1, K2, . . . , Kn etc. may be the same or different.

Although the present disclosure has been described with reference to the drawings, the embodiments disclosed in the drawings are intended to illustrate the embodiments of the present disclosure, and should not be construed as a limitation of the present disclosure. The size ratios in the drawings are only schematic and should not be construed as limiting the present disclosure.

The above-mentioned embodiments only exemplarily illustrate the principle and structure of the present disclosure, and are not intended to limit the present disclosure. Those skilled in the art should understand that any changes and improvements made to the present disclosure without departing from the general idea of the present disclosure are within the scope of the present disclosure. The protection scope of the present disclosure shall be as defined in the claims of this application.

What is claimed is:

1. A signal line capacitance compensation circuit, comprising:

a plurality of signal lines;

at least one control line, a compensation capacitor being provided between the control line and at least one of the plurality of signal lines; and a signal source configured to send a charging signal to one or more control lines of the at least one control line, the charging signal being used to charge the compensation capacitor between the one or more control lines receiving the charging signal and the at least one signal line;

wherein the at least one control line comprises a third control line, the plurality of signal lines comprises a second signal line, a first branch and a second branch connected in parallel are provided between the third control line and the second signal line, the first branch comprises a first compensation capacitor, the second branch comprises a branch switch and a second compensation capacitor connected in series, and a control terminal of the branch switch is electrically connected to the second signal line.

2. The signal line capacitance compensation circuit according to claim 1, wherein the at least one control line comprises a first control line and a second control line, and the plurality of signal lines comprises a first signal line, and a capacitance value of the compensation capacitor between the first control line and the first signal line is different from a capacitance value of the compensation capacitor between the second control line and the first signal line.

3. The signal line capacitance compensation circuit according to claim 1, further comprising:

a switching element configured to control an on-off state between the signal source and the compensation capacitor; and a switching trigger line configured to provide a compensation trigger signal to the switching element, wherein the switching element comprises:

a first connection terminal, the first connection terminal being connected to the signal source;

a second connection terminal, the second connection terminal being connected to the compensation capacitor; and a control terminal, the control terminal being connected to the switching trigger line.

4. The signal line capacitance compensation circuit according to claim 1, wherein the at least one control line further comprises a fourth control line, a third compensation capacitor is provided between the fourth control line and the second signal line, and the signal source is configured to send the charging signal to only one of the third control line and the fourth control line at a same moment.

5. The signal line capacitance compensation circuit according to claim 4, wherein a capacitance value of the third compensation capacitor is the same as that of the first compensation capacitor.

6. A signal line capacitance compensation circuit, comprising:

a plurality of signal lines;

at least one control line, a compensation capacitor being provided between the control line and at least one of the plurality of signal lines; and a signal source configured to send a charging signal to one or more control lines of the at least one control line, the charging signal being used to charge the compensation capacitor between the one or more control lines receiving the charging signal and the at least one signal line;

wherein the plurality of signal lines comprise a first signal line, and the at least one control line comprises a first control line and a third control line, a fourth compensation capacitor is formed between the first control line and the first signal line, and a first branch and a second branch connected in parallel are provided between the third control line and the first signal line, the first branch comprises a fifth compensation capacitor, the second branch comprises a branch switch and a sixth compensation capacitor connected in series, and a control terminal of the branch switch is electrically connected to the first signal line.

7. The signal line capacitance compensation circuit according to claim 6, wherein the at least one control line further comprises a fourth control line, a seventh compensation capacitor is provided between the fourth control line and the first signal line, and the signal source is configured to send the charging signal to only one of the third control line and the fourth control line at a same moment.

8. The signal line capacitance compensation circuit according to claim 7, wherein a capacitance value of the fifth compensation capacitor is the same as that of the seventh compensation capacitor.

9. The signal line capacitance compensation circuit according to claim 6, wherein the at least one control line further comprises a second control line, an eighth compensation capacitor is formed between the second control line and the first signal line, and a capacitance value of the fourth compensation capacitor is different from that of the eighth compensation capacitor.

10. The signal line capacitance compensation circuit according to claim 6, further comprising:

at least one capacitance compensation line, wherein a ninth compensation capacitor having a constant value is provided between the capacitance compensation line and at least one signal line of the plurality of signal lines, and the ninth compensation capacitor maintains a constant state of charge.

11. A display panel, comprising:

a display area for displaying images; and a non-display area at least partially surrounded by the display area, the non-display area comprising a signal line capacitance compensation area, wherein the signal line capacitance compensation area comprises a signal line layer and a control line layer, a plurality of signal lines in the signal line layer overlap with at least one control line in the control line layer, the control line layer and the signal line layer are separated by an insulating layer to form a compensation capacitor at an overlapping portion of the control line and the signal lines, and wherein the display panel further comprises a signal source, the signal source is configured to send a charging signal to one or more control lines of the at least one control line, the charging signal is used to charge the compensation capacitor between the one or more control lines receiving the charging signal and the at least one signal line.

12. The display panel according to claim 11, wherein the at least one control line comprises a first control line and a second control line, and the plurality of signal lines comprise a first signal line, an overlapping area of the first control line and the first signal line is different from that of the second control line and the first signal line.

13. The display panel according to claim 12, wherein the signal line capacitance compensation area further comprises a control line expansion layer, the control line expansion layer is located on a side of the signal line layer facing away from the control line layer, and is separated from the signal line layer by another insulating layer, the control line expansion layer is provided with at least one expansion control line, and each expansion control line is electrically connected to one control line in the control line layer through a conductive path, the expansion control line overlaps at least one signal line in the signal line layer, wherein the compensation capacitor comprises a first sub-compensation capacitor and a second sub-compensation capacitor, the first sub-compensation capacitor is formed by the overlapping portion of the control line and the signal line, and the second sub-compensation capacitor is formed by an overlapping portion of the expansion control line and the signal line.

14. The display panel according to claim 12, wherein a switching element is further provided in the signal line capacitance compensation area, and the switching element is configured to control an on-off state of the signal source and the compensation capacitor, wherein the switching element comprises a thin film transistor, the thin film transistor comprises:

a source electrode and a drain electrode disposed in a source-drain layer;

an active layer;

a gate electrode between the source-drain layer and the active layer;

a first insulating layer between the active layer and the gate electrode; and a second insulating layer between the source-drain layer and the gate electrode, wherein the source electrode and the drain electrode are disposed in a same layer as the at least one control line, and the gate electrode is disposed in a same layer as the first signal line, and the source electrode and the drain electrode are electrically connected to the active layer via conductive paths passing through the first insulating layer and the second insulating layer, respectively.

15. The display panel according to claim 12, wherein the at least one control line comprises a third control line, the plurality of signal lines comprises a second signal line, and the third control line has a trunk portion and a branch portion extending from the trunk portion, the trunk portion comprises a first overlapping portion overlapping with the second signal line, and the branch portion comprises a second overlapping portion overlapping with the second signal line, and the second overlapping portion and the first overlapping portion are spaced apart from each other.

16. The display panel according to claim 15, wherein the branch portion comprises a first portion connected to the trunk portion and a second portion comprising the second overlapping portion, the signal line capacitance compensation area is further provided with:

a branch switch configured to control an on-off state of the first portion and the second portion in response to a branch trigger signal from the second signal line.

17. The display panel of claim 16, wherein the branch switch comprises a thin film transistor, the thin film transistor comprises:

a source electrode and a drain electrode disposed in a source-drain layer;

an active layer;

a gate electrode between the source-drain layer and the active layer;

a first insulating layer between the active layer and the gate; and a second insulating layer between the source-drain layer and the gate electrode, wherein the source electrode and the drain electrode are disposed in a same layer as the third control line, the gate electrode and the second signal line are disposed in a same layer, the gate electrode is electrically connected to the second signal line, the source electrode and the drain electrode are electrically connected to the active layer via conductive paths passing through the first insulating layer and the second insulating layer, respectively, wherein the first portion and the second portion of the branch portion are respectively used as the drain electrode and the source electrode of the branch switch.

18. The display panel according to claim 17, wherein the at least one control line comprises a fourth control line, and the fourth control line is provided with a third overlapping portion overlapping with the second signal line.

19. The display panel according to claim 18, wherein an area of the third overlapping portion is the same as an area of the first overlapping portion.

* * * * *